US010982542B2

(12) United States Patent
Corbett

(10) Patent No.: US 10,982,542 B2
(45) Date of Patent: Apr. 20, 2021

(54) ROCK BOLT

(71) Applicant: RAND YORK CASTINGS (PTY) LIMITED, Durban (ZA)

(72) Inventor: Michael Robert Corbett, Durban (ZA)

(73) Assignee: RAND YORK CASTINGS (PTY) LIMITED, Durban (ZA)

( * ) Notice: Subject to any disclaimer, the term of this patent is extended or adjusted under 35 U.S.C. 154(b) by 0 days.

(21) Appl. No.: 16/647,309

(22) PCT Filed: Sep. 14, 2018

(86) PCT No.: PCT/IB2018/057068

§ 371 (c)(1),
(2) Date: Mar. 13, 2020

(87) PCT Pub. No.: WO2019/053653

PCT Pub. Date: Mar. 21, 2019

(65) Prior Publication Data

US 2020/0277856 A1 Sep. 3, 2020

(30) Foreign Application Priority Data

Sep. 15, 2017 (ZA) ..... 2017/06266

(51) Int. Cl.
*E21D 21/00* (2006.01)
*E21D 20/02* (2006.01)

(52) U.S. Cl.
CPC ..... *E21D 21/0006* (2013.01); *E21D 20/02* (2013.01); *E21D 21/008* (2013.01); *E21D 21/0053* (2016.01)

(58) Field of Classification Search
CPC . C22C 38/04; E21D 21/0006; E21D 21/0053; E21D 20/02; E21D 21/008; E02D 5/80
See application file for complete search history.

(56) References Cited

U.S. PATENT DOCUMENTS 8,337,120 B2 * 12/2012 Li ..... E21D 21/008 405/259.5
2003/0031525 A1 * 2/2003 Fergusson ..... F16B 15/00 411/82
2010/0021245 A1 * 1/2010 Li ..... E21D 21/008 405/259.5
2015/0337659 A1 * 11/2015 Fechte-Heinen ..... C22C 38/04 405/259.1
2016/0177718 A1 * 6/2016 Cawood ..... E21D 21/0006 405/259.5
2018/0245468 A1 * 8/2018 Mesplont ..... E21D 21/006
2019/0203599 A1 * 7/2019 Sun ..... G01L 5/0004
2020/0070476 A1 * 3/2020 Kim ..... C22C 38/42

OTHER PUBLICATIONS

Atlas Copco, "Atlas Copco Rock Reinforcement Product, Product Catalogue", pp. 1-55 (Year: 2008).*

* cited by examiner

*Primary Examiner* — Carib A Oquendo
(74) *Attorney, Agent, or Firm* — Jason P. Mueller; FisherBroyles, LLP

(57) ABSTRACT

The invention relates to a sleeveless energy absorbing rock bolt. A first end of the rock bolt is configured to facilitate the mixing of an anchoring composition and/or anchoring the rock bolt in the rock. The rock bolt comprises manganese alloyed steel, and exhibits, post the yield point thereof, under static load conditions, an increase in load capacity and an increasing displacement until the break or fail point of the rock bolt is reached.

21 Claims, 34 Drawing Sheets

| Number | Dia (mm) | Length (mm) | Max load (KN) | Elongation (mm) | Remarks |
|---|---|---|---|---|---|
| A | 25 | 1700 | 343 | 300 | Rate: 135 mm/min |
| B | 25 | 1700 | 376 | 367 | Rate: 90 mm/min |
| C | 25 | 1700 | 373 | 354 | Rate: 90 mm/min |
| D | 25 | 1700 | Stopped @ 350 KN | 313 | Rate: 90 mm/min. Test interrupted at 200, 300 and 350 KN to measure diameter |

FIGURE 12

| Diameter measurements on Bolt D (results in mm) | | | | | |
|---|---|---|---|---|---|
| | Load( KN) | Posn 1 | Posn 2 | Posn 3 | |
| | 0 | 25.37 | 25.37 | 25.37 | Posn 2 was approximately central in the bar; Posn's 1 & 3 were approx. 500 mm away on each side |
| | 200 | 25.19 | 25.18 | 25.17 | |
| | 300 | 23.09 | 23.19 | 23.03 | |
| | 350 | 23.45 | 23.08 | 23.03 | |

FIGURE 13

| Number | Dia (mm) | Length (mm) | Max load (KN) | Elongation (mm) | Remarks |
|---|---|---|---|---|---|
| 2 | 25 | 1650 | 374 | 383 | Debonded – fractured on thread |
| 3 | 25 | 1650 | 389 | 411 | Debonded – fractured inside pipe |
| 4 | 25 | 1650 | 395 | 410 | Debonded – fractured inside pipe |
| 5 | 25 | 1650 | 391 | 390 | Debonded – fractured inside pipe |
| 6 | 25 | 1650 | 377 | 395 | Debonded – fractured inside pipe |

| Number | Dia (mm) | Length (mm) | Max load (KN) | Elongation (mm) | Remarks |
|---|---|---|---|---|---|
| 7 | 25 | 1650 | 381 | 354 | Debonded – fractured inside pipe |
| 8 | 25 | 1650 | 404 | 455 | Debonded – fractured on thread |
| 9 | 25 | 1650 | 384 | 386 | Debonded – fractured inside pipe |

| Number | Energy absorbed (KJ) |
|---|---|
| A | 75 |
| B | 99 |
| C | 99 |
| D | 83 |

FIGURE 19

| Number | Energy absorbed (KJ) |
|---|---|
| 2 | 110 |
| 3 | 118 |
| 4 | 116 |
| 5 | 111 |
| 6 | 107 |

FIGURE 20

| Number | Energy absorbed (KJ) |
|---|---|
| 7 | 103 |
| 8 | 132 |
| 9 | 111 |

FIGURE 21

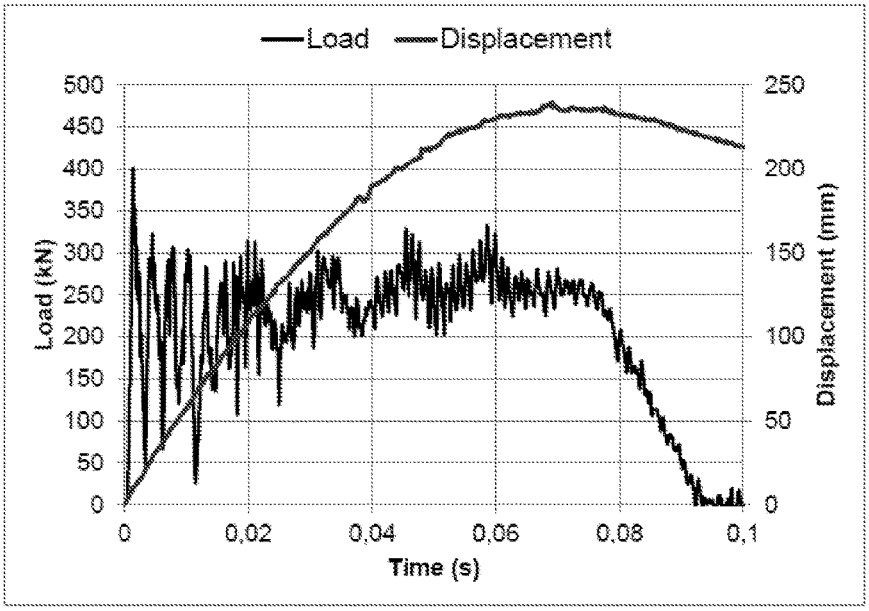

FIGURE 26

| Test No. | Sample ID | Drop mass $m$ (kg) | Mass drop height $h$ (m) | Impact energy $E$ (kJ) | Velocity at impact $v$ (m/s) | First force peak $F_1$ (kN) | Max. load $F_{max}$ (kN) | Diameter of the bar (after the test) $D_{ta}$ (mm) | Total elongation (after the test) $L_{max}$, mm | Post-test sample condition |
|---|---|---|---|---|---|---|---|---|---|---|
| 1 | 1 (2 nuts) | 2825 | 1.835 | 50.85 | 6.0 | 416.3 | 416.3 | 23.6 | 202 | The bolt was not destroyed; The nuts were free running after the testing |
| 2 | 2 (2 nuts) | | | | | 371.8 | 371.8 | 23.7 | 203 | |
| 3 | 3 (1 nut) | | | | | 355.5 | 355.5 | 23.5 | 211 | The bolt was not destroyed; The nut was free running after the testing |
| 4 | 4 (1 nut) | | | | | 388.9 | 388.9 | 23.5 | 207 | |
| 5 | 5 (1 nut) | | | | | 401.4 | 401.4 | 23.6 | 208 | |

FIGURE 27

| Test No. | Sample ID | Drop mass $m$ (kg) | Mass drop height $h$ (m) | Impact energy $E$ (kJ) | Velocity at impact $v$ (m/s) | First force peak $F_1$ (kN) | Max. load $F_{max}$ (kN) | Diameter of the bar (after the test) $D_{ts}$ (mm) | Total elongation (after the test) $L_{max}$ (mm) | Post-test sample condition |
|---|---|---|---|---|---|---|---|---|---|---|
| 6 | 6 (1 nut) | 2825 | 1.835 | 50.85 | 6.0 | 378.1 | 378.1 | 23.8 | 201 | The bolt was not destroyed; The nuts were free running after the testing. |
| 7 | 7 (1 nut) | | | | | 377.5 | 377.5 | 23.7 | 206 | |
| 8 | 8 (1 nut) | | | | | 392.8 | 392.8 | 23.5 | 205 | |
| 9 | 9 (1 nut) | | | | | 367.3 | 367.3 | 23.5 | 204 | |
| 10 | 10 (1 nut) | | | | | 380.4 | 380.4 | 23.4 | 212 | |

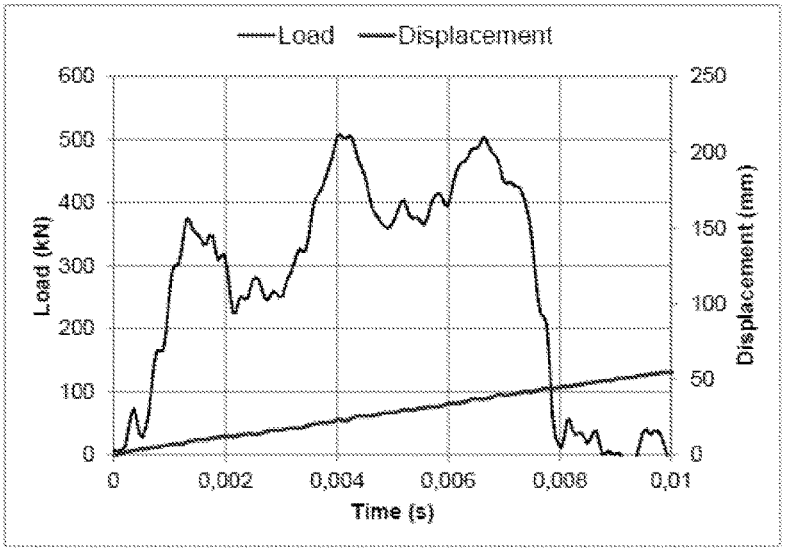

FIGURE 46

| Test No. | Sample ID | Drop mass $m$ (kg) | Mass drop height $h$ (m) | Impact energy $E$ (kJ) | Velocity at impact $v$ (m/s) | First force peak $F_1$ (kN) | Max. load $F_{max}$ (kN) | Total elongation (after the test) $L_{max}$, mm | Post-test sample condition |
|---|---|---|---|---|---|---|---|---|---|
| 11 | 1 (1 nut) – 2nd drop | | | | | 447.8 | 514.4 | 202+140=342 (After 1st drop $L_{max}$=202 mm) | The bolt was not destroyed. The nuts were free running after the testing. |
| 12 | [redacted] | | | | | [redacted] | [redacted] | [redacted] | [redacted] |
| 13 | [redacted] | | | | | [redacted] | [redacted] | [redacted] | [redacted] |
| 14 | 1 (1 nut) – 3rd drop | | | | | 401.5 | 504.8 | 201+139=341 (After 1st drop $L_{max}$=201 mm) | The bolt was not destroyed. The nuts were free running after the testing. |
| 15 | 2 (1 nut) – 3rd drop | | | | | 410.0 | 526.1 | 541 | The bolt was not destroyed. The nuts were free running after the testing. There was extension of the bolt rod from the upper section of the pipe. |
| 16 | 2 (1 nut) – 4th drop | 2825 | 1.835 | 50.85 | 6.0 | 435.0 | 509.5 | 619 | |
| 17 | [redacted] | | | | | [redacted] | [redacted] | [redacted] | [redacted] |
| 18 | 3 (1 nut) – 2nd drop | | | | | 475.7 | 502.5 | 211+145=356 (After 1st drop $L_{max}$=211 mm) | The bolt was not destroyed. The nuts were free running after the testing. |
| 19 | 3 (1 nut) – 3rd drop | | | | | 408.5 | 536.0 | 473 | |
| 20 | [redacted] | | | | | [redacted] | [redacted] | [redacted] | [redacted] |
| 21 | 4 (1 nut) – 2nd drop | | | | | 415.5 | 517.7 | 207+143=350 (After 1st drop $L_{max}$=207 mm) | The bolt was not destroyed. The nuts were free running after the testing. |
| 22 | 4 (1 nut) – 3rd drop | | | | | 401.8 | 546.1 | 467 | The bolt was not destroyed. The nuts were free running after the testing. |
| 23 | [redacted] | | | | | [redacted] | [redacted] | - | [redacted] |

FIGURE 47

| Test No. | Sample ID | Drop mass $m$ (kg) | Mass drop height $h$ (m) | Impact energy $E$ (kJ) | Velocity at impact $v$ (m/s) | First force peak $F_1$ (kN) | Max. load $F_{max}$ (kN) | Total elongation (after the test) $L_{max}$, mm | Post-test sample condition |
|---|---|---|---|---|---|---|---|---|---|
| 24 | 8 (1 nut) – 2nd drop | 2825 | 1.835 | 50.85 | 6.0 | 373.1 | 445.2 | 346 | The bolt was not destroyed. The nuts were free running after the testing. |
| 25 | 8 (1 nut) – 3rd drop | | | | | 361.7 | 500.9 | 461 | |
| 26 | [redacted] | | | | | [redacted] | [redacted] | [redacted] | [redacted] |
| 27 | 9 (1 nut) – 2nd drop | | | | | 419.7 | 466.5 | 345 | The bolt was not destroyed. The nuts were free running after the testing. |
| 28 | 9 (1 nut) – 3rd drop | | | | | 415.5 | 525.0 | 460 | |
| 29 | [redacted] | | | | | [redacted] | [redacted] | [redacted] | [redacted] |
| 30 | 10 (1 nut) – 2nd drop | | | | | 347.8 | 405.8 | 345 | The bolt was not destroyed. The nuts were free running after the testing. |
| 31 | 10 (1 nut) – 3rd drop | | | | | 361.8 | 498.6 | 471 | |
| 32 | 10 (1 nut) – 4th drop | | | | | 414.0 | 535.5 | 574 | The bolt was not destroyed. The nuts were free running after the testing. There was extension of the bolt rod from the upper section of the pipe. |
| 33 | [redacted] | | | | | [redacted] | [redacted] | [redacted] | [redacted] |

FIGURE 58

Necking of carbon steel during displacement
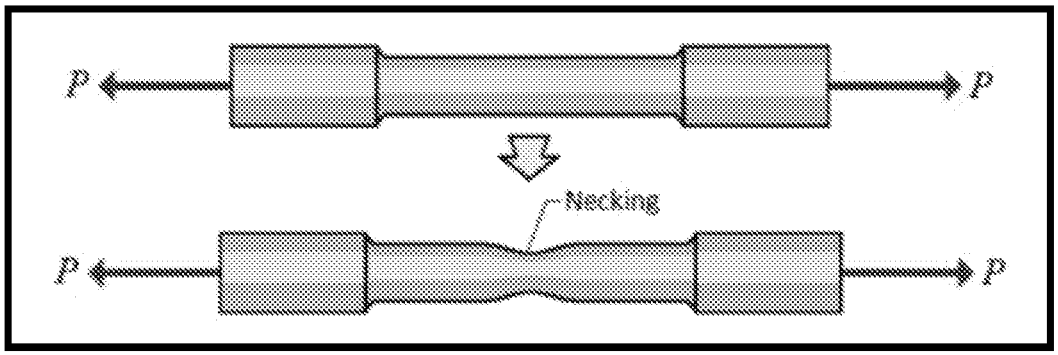
Uniform reduction of manganese steel during displacement
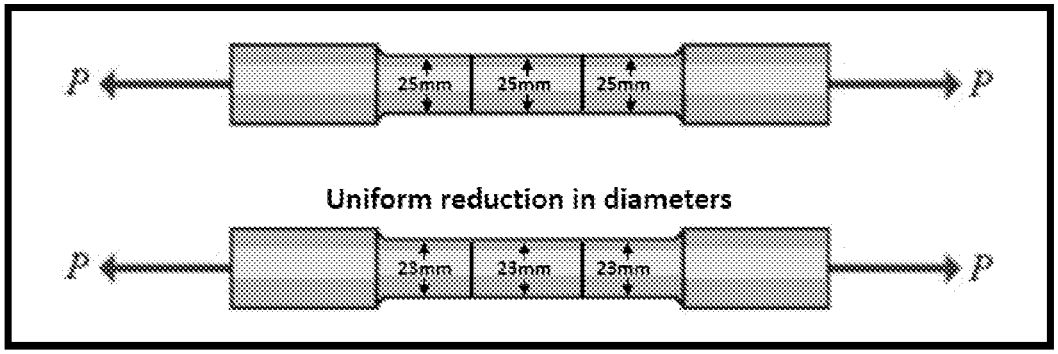
FIGURE 59 a (Load case 1)

b (Load case 2)

ROCK BOLT

This application is a national stage entry under 35 U.S.C. 371 of PCT Patent Application No. PCT/IB2018/057068, filed Sep. 14, 2018, which claims priority to South Africa Patent Application No. 2017/06266, filed Sep. 15, 2017, the entire contents of each of which is incorporated herein by reference.

FIELD OF THE INVENTION

The invention relates to a rock bolt for use in mining and tunnelling operations, including civil engineering applications such as geotechnical applications and/or seismic designs for buildings.

BACKGROUND TO THE INVENTION

There are three types of conventional rock bolts categorised according to their anchoring mechanisms:

1. Two-point fixed mechanical bolts
2. Fully encapsulated rebar bolts
3. Frictional bolts Conventional mechanical bolts are not the most reliable for stabilising large rock deformations. Fully encapsulated/grouted rebar bolts are fused to the grout/ epoxy resin and rock with ribs forming the link to the grout or resin. Rebar is tough but rigid—it has a high load capacity but cannot withstand large rock deformations and would be unlikely to survive a deformation greater than 2-3 centimetres (Kabwe and Wang, 2015). As their name suggests, frictional rock bolts interact with the rock through the wall and the cylinder-shaped surface of the bolt (for example Swellex™ or Omega™ bolts). They can endure large rock deformations but have a low load bearing capacity. For example, a standard split set bolt may only endure a load of around 50 kN.

Rebar and split-set bolts are therefor low energy-absorbing devices and are not optimal for use in deep mines which are more susceptible to seismic activity and which require supports that can withstand high loads (absorb a large amount of energy before failure) and also withstand large deformations in order to avoid rockfalls and concomitant fatalities.

Some of the identified prior art will be discussed below:

CN203962010U discloses an anchor rod which includes a bolt and fixing assembly, wherein the fixing assembly is an anchor rod formed of a high manganese steel. The reasons why high manganese steel is used in these bolts or parts thereof, has not been disclosed, but appears to be because of its characteristic toughness. The configuration is complicated. CN203962010U also specifically includes a sleeve which acts as a de-bonding means, confirming that Manganese steel was used because of its toughness and not because of its deformation properties.

CN204080802U discloses an anchor bolt used for slope protection and which comprises a circular bolt made of coarse rust-proof steel or high manganese steel. The configuration thereof is also complicated. The reasons why high manganese steel is used in these bolts or parts thereof, has also not been disclosed, but again appears to be because to its toughness. CN204080802U includes a flexible dragline which appears to function as a de-bonding means should the slope shift, confirming that Manganese steel was used because of its toughness and not because of its deformation properties.

WO2012126042A1 discloses an inflatable friction bolt. A central portion of the bolt is defined by an inflatable body, typically formed of high manganese steel. The plasticity of the high manganese steel was used to increase diameter and therefore enhance frictional resistance. The methodology of using frictional resistance in a rock bolt (typically referred to as friction rock bolts) is fundamentally different to the methodology of using the rock bolts of the current invention.

It was proposed by Li (Li, 2010) that the ideal energy absorbing bolt for use in rock masses susceptible to large deformation should behave as per that labelled in the graph shown in FIG. 1 (Kabwe and Wang, 2015). This illustrates that the ideal energy absorbing bolt should have a high load capacity and large capacity for deformation/displacement.

The performance of various energy-absorbing rock bolts and the results are included in the specification as FIGS. 2 and 3, respectively, for ease of reference (Kabwe and Wang, 2015).

The best performing bolt in the study by Kabwe and Wang was the D-bolt (U.S. Pat. No. 8,337,120) which absorbs energy through fully mobilising the strength and deformation capabilities of the bolt steel. As shown by the graphs included herein as FIGS. 4 and 5, the static and dynamic loading capacities of the D-bolt are similar (Li, 2014). Other bolts in the study deform based on mechanisms involving bolt shank slippage, either in the grout (cone bolt or yield-lok™) or through the anchor (Garford and Roofex bolts). The slippage-based bolts are shown by the graphs, included as FIGS. 6, 7, 8 and 9 to have ultimate dynamic loads lower than their static loads (Li, 2014).

The D-bolt comprises micro-alloyed carbon steel and constitutes a smooth steel bar with multiple anchored sections (paddles) reoccurring along its entire length. Although the steel is selected for its optimal combination of yield strength, ultimate tensile strength (UTS) and elongation, it is a carbon steel and Manganese is not specified.

The most important imperfections in carbon steel (on a very small scale) are dislocations. Dislocations can be considered the results of a distorted boundary or a line imperfection between two perfect regions of the crystal structure. These dislocations assist with deformation in steel by a process called slip (dislocation glide). In the absence of these dislocations, much higher stress would be needed to cause deformation of the steel.

During a tensile test (when a tensile load is applied) of carbon steel, when the stress reaches a critical level, plastic deformation will occur at the weakest part of the sample being tested, which is somewhere along the gauge length. This local extension under tensile loading will cause a simultaneous area constriction so that the true local stress is higher at this location than anywhere else along the gauge length. Consequently it would be expected that all additional deformation would concentrate in this most highly stressed region. Such would be the case in an ideally plastic material. However, for normal materials, this localised plastic deformation strain hardens the material, thereby making it more resistant to further damage. At this point the applied stress must be increased to produce additional plastic deformation at the second weakest position along the gauge length. Here again, the material strain hardens and the process continues. On a macroscopic scale, the gauge length extends uniformly together with a reduction in cross-sectional area. With increasing load, a point is reached where the strain hardening capacity of the material is exhausted and the local area contraction is no longer balanced by a corresponding increase in material strength. At this maximum load, further plastic deformation is localised in the necked region since the stress increases continually with a real contraction even though the applied load is decreasing as a result of elastic unloading in the test bar outside the necked area. Eventually the neck will fail.

It is therefor an object of the current invention to provide an improved-energy absorbing bolt or yielding bolt which exhibits stiff behaviour at the onset of loading, as well as high strength and exceptional deformation characteristics which allows the rock bolt of the invention to overcome or alleviate the problems associated with carbon steel rock bolts, and which allows the rock bolt of the invention to perform better than the prior art rock bolts. Such a bolt would be useful in combatting instability problems such as high stress-induced instability problems, including rockbursts and rock squeezing that is commonly found in deep mines.

In this specification, displacement is defined as uniform reduction in diameter without necking or breaking along the entire displacement zone of the rock bolt, which is typically the smooth bar region of the rock bolt.

REFERENCES

Li, C. C. (2010) A New Energy-Absorbing Bolt for Rock Support in High Stress Rock Masses. International Journal of Rock Mechanics & Mining Sciences, 47, 396-404. http://dx.doi.org/10.1016/j.ijrmms.2010.01.005

Kabwe, E. and Wang, Y. (2015) Review on Rockburst Theory and Types of Rock Support in Rockburst Prone Mines. Open Journal of Safety Science and Technology, 5, 104-121. http://dx.doi.org/10.4236/ojsst.2015.54013

Li CC, et al. A review on the performance of conventional and energy-absorbing rockbolts. Journal of Rock Mechanics and Geotechnical Engineering (2014), http://dx.doi.org/10.1016/j.jrmge.2013.12.008

SUMMARY OF INVENTION

According to an aspect of the invention there is provided a sleeveless energy absorbing rock bolt, a first end of the rock bolt being configured to facilitate the mixing of an anchoring composition and/or anchoring the rock bolt in the rock, characterised in that the rock bolt comprises manganese alloyed steel, and exhibits, post the yield point thereof, under static load conditions, an increase in load capacity and an increasing displacement until the break or fail point of the rock bolt is reached.

A second end of the rock bolt is configured to receive a securing means for securing the second end of the rock bolt relative to the rock face.

Under static load conditions, the increase in load capacity is substantially linear.

Under static load conditions, the ultimate tensile strength and break point of the rock bolt is substantially the same.

Post the yield point thereof, under dynamic load conditions, the load capacity and displacement of the rock bolt increases until a point or threshold is reached at which the first end of the rock bolt is dislocated from the anchoring composition or dislocated from an anchor point at which the first end is anchored in the rock. As the first end is dislocated, it starts anchor ploughing or dragging against its surroundings which in turn absorbs additional energy.

The increase in load capacity and the increasing displacement exhibited by the rock bolt of the invention under static and dynamic load conditions significantly exceeds industry standards.

The rock bolt has a dynamic load capacity greater than the static load capacity thereof.

Also in the preferred form of the invention, the configurations further include one or more work-hardened zones defining a displacement zone or deformation zone therebetween, which, under the influence of a sudden dynamic load or static load, instantaneously debonds from the anchoring composition along the length of the displacement zone.

In the preferred form of the invention, the displacement zone is a smooth bar region which has not been work hardened. The smooth bar region deforms evenly and instantaneously along the length thereof, the deformation being instantaneously and evenly extended upon application of a series of shocks, the quantum of the extension becoming progressively less for each shock received.

In the preferred form the manganese content of the steel used to manufacture the rock bolt is in the range of 10 to 24%. More preferably, the manganese content of the steel used to manufacture the rock bolt is in the range of 10 to 18%. Optimally, the manganese content used is approximately 17%.

The configuration of the rock bolt having two work hardened end regions and the smooth bar region therebetween, is specifically configured to be used with the rock bolt which is manufactured using the above manganese content. A rock bolt manufactured from any other material or combination of materials, which has the same configuration as described above, will not achieve the same level of success as the rock bolt of the invention. For example, a carbon steel rock bolt which includes the same configuration would not achieve the same success as the rock bolt of the invention because of the characteristics of the carbon steel.

The manganese alloyed steel is a transformation induced plasticity steel, in which the metastable austenite transforms to martensite during deformation of the steel. The mechanical properties of the steel are the result of the transformation induced plasticity in the steel which leads to enhanced work hardening rate, postponed onset of necking and excellent formability.

In the manganese alloyed steel, the metastable austenite will not only deform plastically, but it transforms to the more stable $\alpha'$– martensite upon application of a tensile load. The exceptional mechanical properties of the steel are directly related to this strain-induced phase transformation. Exceptional work hardening as well as phase transformation occurs during mechanical deformation. The deformation of the steel occurs by a combination of slip or dislocation glide (as described above) and a secondary transformation to martensite. The martensite platelets that form as a result of the transformation act as planar obstacles and reduce the mean free path of the dislocation glide. Dislocations pile up at interfaces between these planar defects and the matrix and causes significant back stresses that impede the progress of similar dislocations. The significant work hardening caused by these planar defects delays local necking and results in increasing linear displacement.

The use of manganese in prior art rock bolts as in many other industrial applications such as the "load bins" or wear parts such as teeth/jaws of yellow machinery, has been because it is tough and becomes work hardened with continuous and repeated impact. To the applicant's knowledge this is the first application in which manganese content has been specified to assist in producing a fixed mechanical rock bolt, a rebar bolt, and/or yielding bolt which exhibits the properties of energy absorption and displacement which exceeds the industry standard for rock bolts.

The work hardened zones comprise the formation of one or more paddles at the first end to facilitate mixing of the anchoring composition and providing a larger surface area for bonding with the composition. At the second end, the work hardened zone comprises thread formed on the bar for attachment of the securing means.

The securing means is preferably in the form of a nut, wherein the second end of the rock bolt is threaded to receive the nut for tightening a bearing plate relative to the rock face.

The anchoring composition is preferably a resin grout. The resin grout may comprise resin capsules. The anchoring composition may be a cementitious grout.

The rock bolt may be anchored by a mechanical anchor, wherein the first end of the rock bolt is configured with a mechanical anchor. The anchor may include an expansion shell.

In the event of either static or dynamic movement of the rock occurring in the direction of the second end of the rock bolt, which is the downward movement of the rock, the tensile load on the rock bolt may increase. The increase in tensile load on the rock bolt results in the displacement of the smooth bar region of the rock bolt which has not been work hardened, which in turn results in a reduction in the diameter of the rock bolt.

The resulting displacement and reduction in diameter naturally breaks the bond between the rock bolt and the resin at the smooth bar region. The reduction in diameter of the rock bolt results in a work hardening of the rock bolt over the length of the smooth bar region which in turn increases the tensile capacity of the rock bolt in that region, thereby increasing the tensile capacity of the rock bolt as the displacement and reduction in diameter takes place.

The shear strength of the rock bolt may increase as a result of the increase in tensile capacity.

The reduction in diameter of the rock bolt and resultant increase in tensile capacity of the rock bolt typically takes place along the length of the rock bolt between the threaded end and the profiled end of the rock bolt, i.e. the smooth bar region.

The length and diameter of the rock bolt may be varied in order to achieve higher tensile capacity and displacement of the rock bolt, for use in different situations.

Given its unique strengthening and displacement characteristics, the rock bolt may absorb significantly more energy than the energy absorption achieved by a traditional steel rock bolt.

The dynamic load capacity of the rock bolt may reach 556 kN.

When a static load is applied on the rock bolt and stopped multiple times, the load holds and there is no fall-off of the load on the rock bolt.

BRIEF DESCRIPTION OF THE DRAWINGS

The invention will now be described with reference to the following non-limiting drawings, in which:

FIG. 12 shows the results of the direct tensile testing carried out on specimens A-D during the first series of static testing of the rock bolt of the invention;

FIG. 13 shows the diameter measurements on specimen D carried out during the first series of static testing of the rock bolt of the invention;

FIG. 19 shows the amounts of energy absorbed by the specimens of the rock bolt of the invention during the first series of static testing;

FIG. 20 shows the amounts of energy absorbed by the 5 specimens tested during the double embedment testing of the rock bolt of the invention;

FIG. 21 shows the amount of energy absorbed by the 3 specimens tested during the direct pull-out tests of the rock bolt of the invention;

FIG. 26 is a graph depicting the results of test 5, a dynamic drop test conducted on a sample rock bolt of the invention which was grouted into a continuous tube;

FIG. 27 is a table showing the results of tests 1 to 5, dynamic drop tests conducted on the sample rock bolts of the invention grouted into continuous tubes;

FIG. 46 is a graph depicting the results of test 23, a $4^{th}$ drop test conducted on the rock bolt after test 22;

FIG. 47 is a table showing the results of tests 11 to 23, dynamic multiple drop tests conducted on the sample rock bolts grouted into continuous tubes;

FIG. 58 is a table showing the results of tests 24 to 33, dynamic multiple drop tests conducted on the sample rock bolts grouted into split tubes;

FIG. 59 are drawings which illustrate the effect on a rock bolt described as necking down, and illustrated the uniform diameter reduction of the manganese alloyed steel of the invention.

DETAILED DESCRIPTION OF DRAWINGS

It should be appreciated to those skilled in the art that, without derogating from the scope of the invention as described, it is possible that there are various alternative embodiments or configurations or adaptions of the invention and its features. As a result, it is possible that the described rock bolt may be modified such that it can be used or applied in other industries, to assist with and improve reinforcement, without derogating from the scope of the invention. The term rock bolt as it applies to the current invention, may therefore be used to describe a similar bolt which is used or adapted to be used in civil engineering applications such as geotechnical applications and/or seismic designs for buildings, amongst others. Such a bolt may therefore be anchored, embedded, installed or otherwise in other environments, or bodies/volumes of other material/s.

Figure 1:
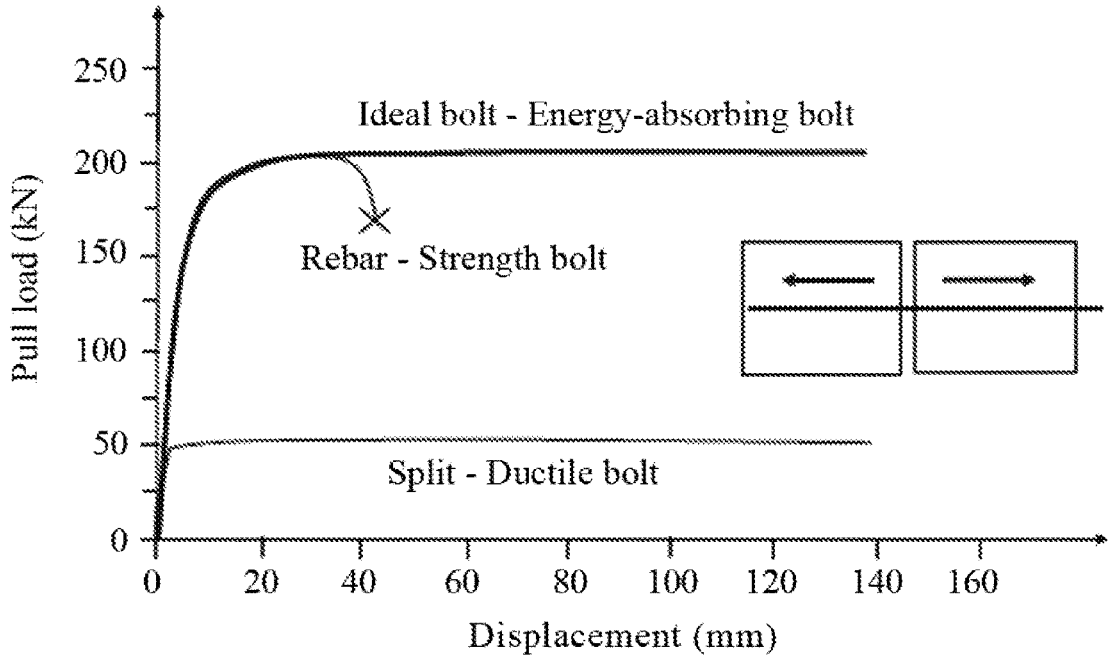
FIG. 1 is a graph showing the "ideal" rock bolt properties relative to the properties of other prior art rock bolts.
Figure 2:
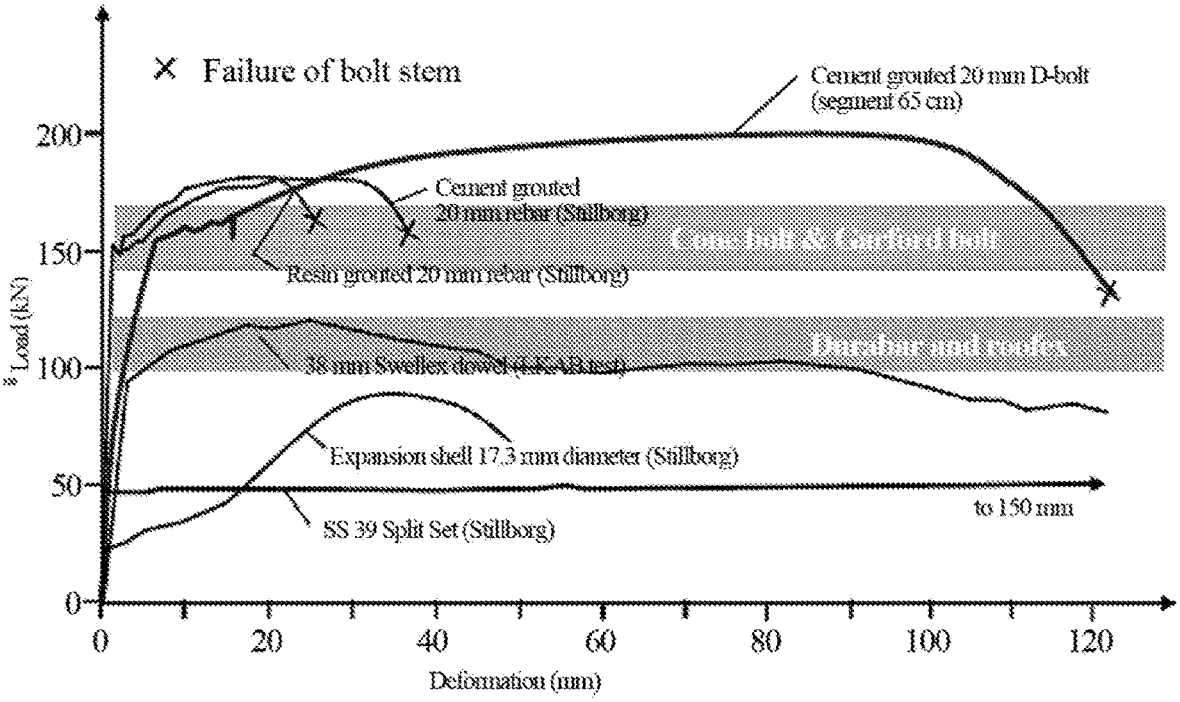
FIG. 2 is a graph showing the displacement characteristics of various prior art rock bolts.
Figure 3:
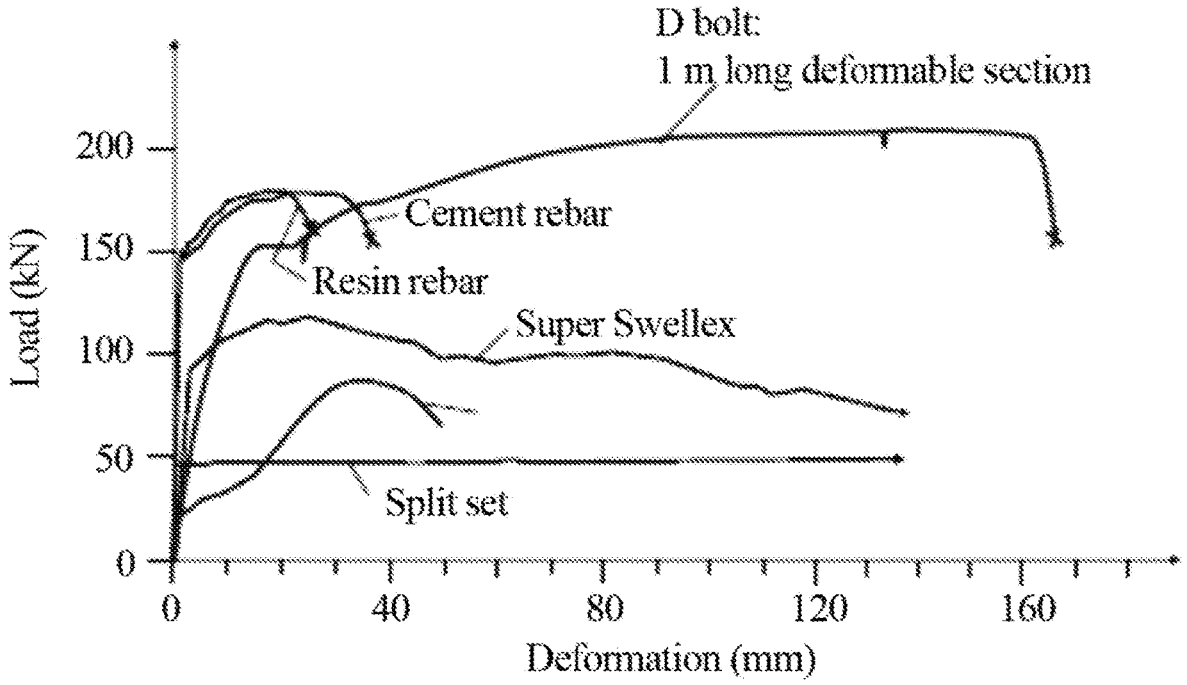
FIG. 3 is a graph showing the load displacement of the prior art rock bolts and the D-bolt, under a pull loading test.
Figure 4:
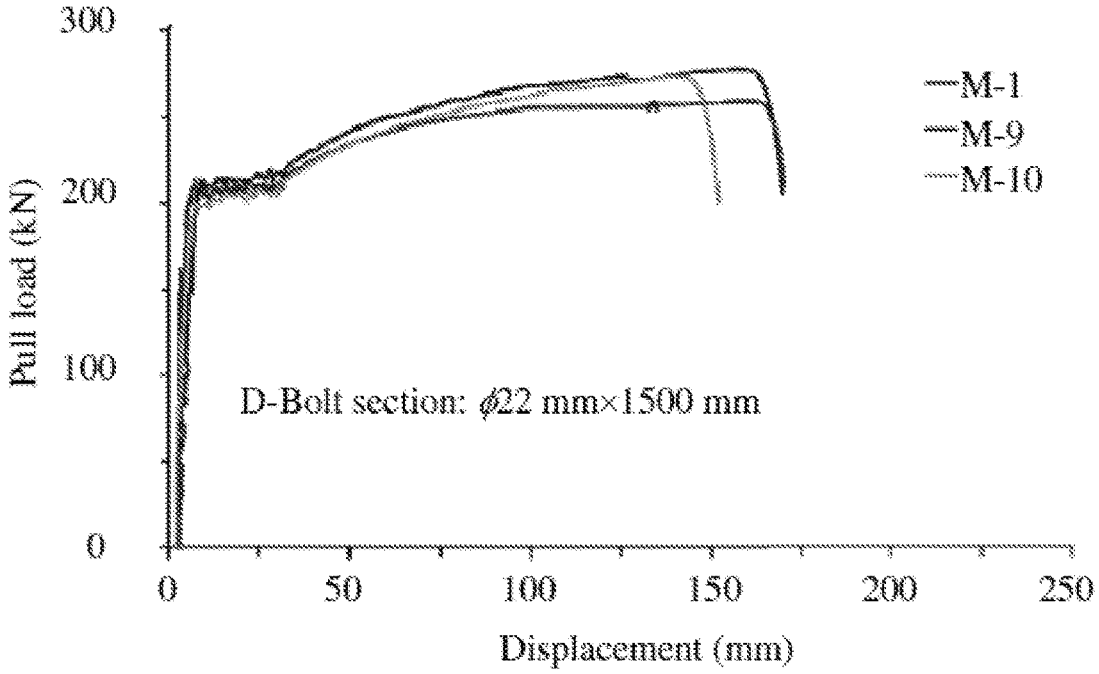
FIG. 4 is a graph showing the static pull test results of the D-bolt rock bolt.
Figure 5:
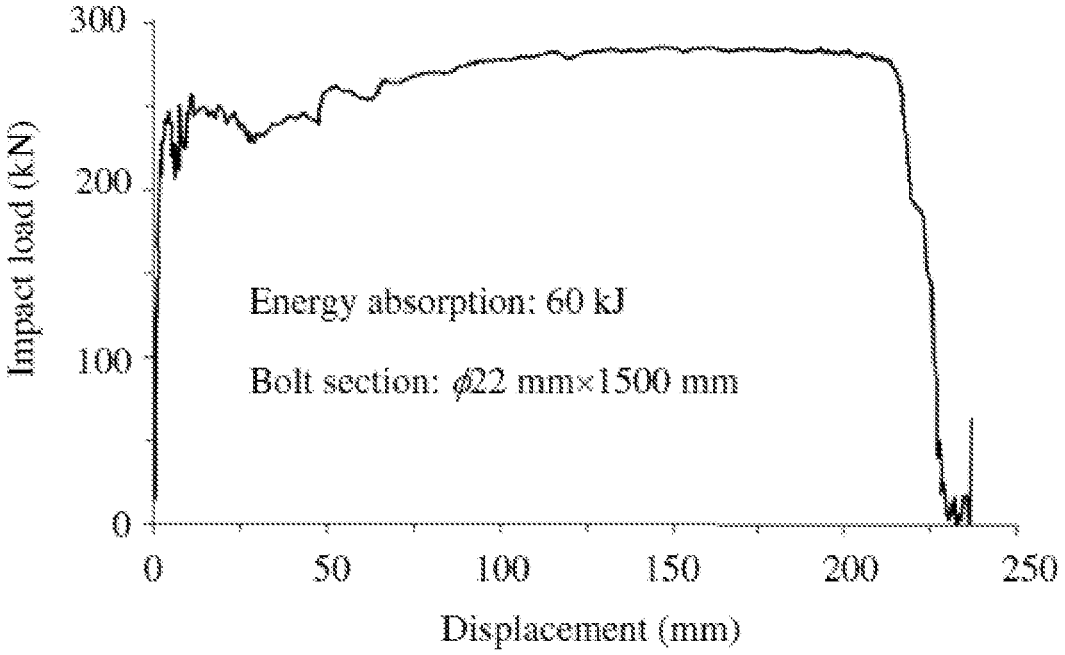
FIG. 5 is a graph showing the dynamic test result of the D-bolt rock bolt.
Figure 6:
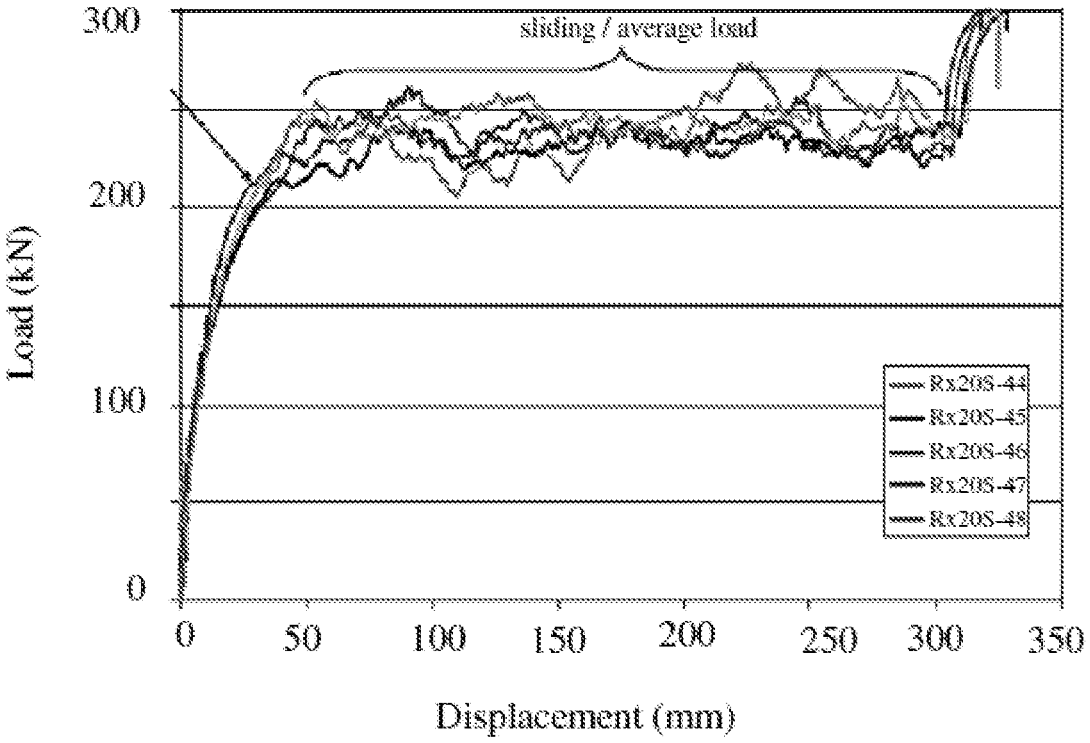
FIG. 6 is a graph showing the static pull test results of the Roofex rock bolt.
Figure 7:
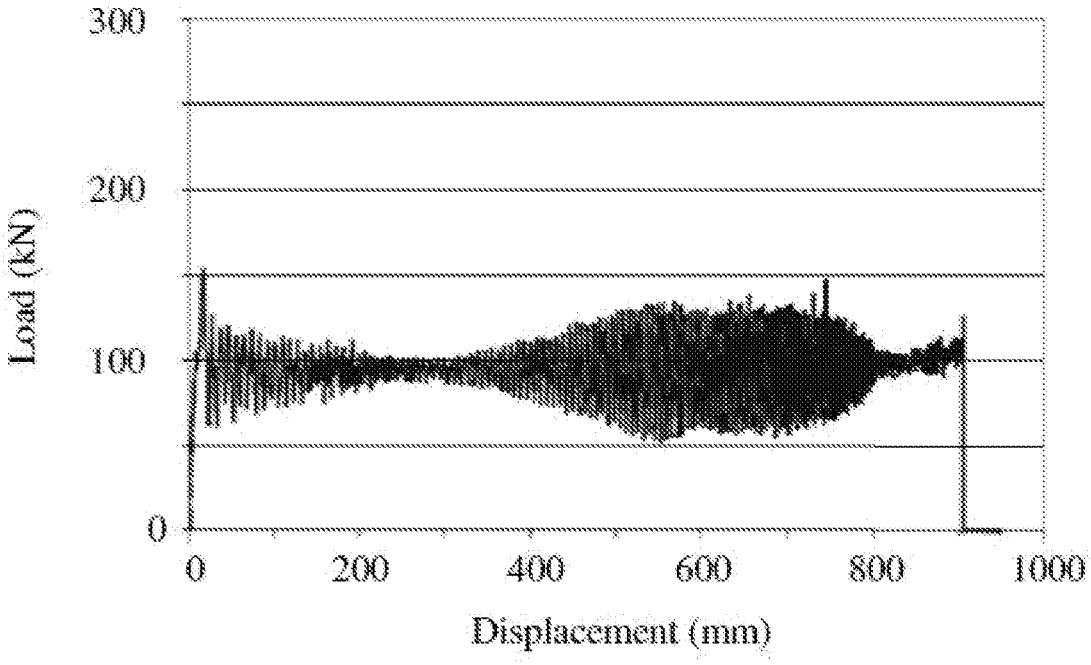
FIG. 7 is a graph showing the dynamic test result of the Roofex rock bolt.
Figure 8:
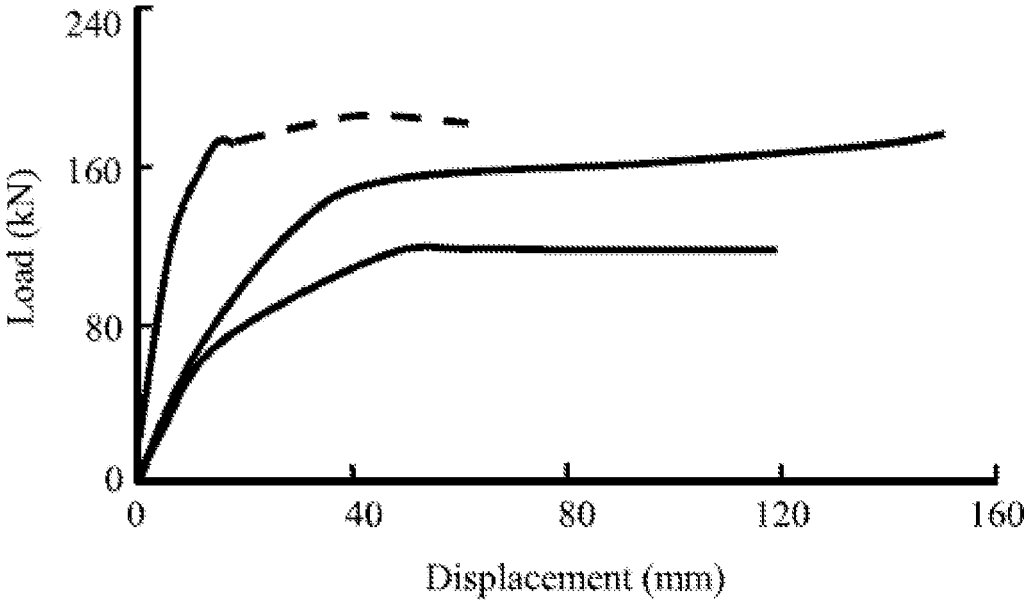
FIG. 8 is a graph showing the static pull test results of the Yield-Lok™ rock bolt.
Figure 9:
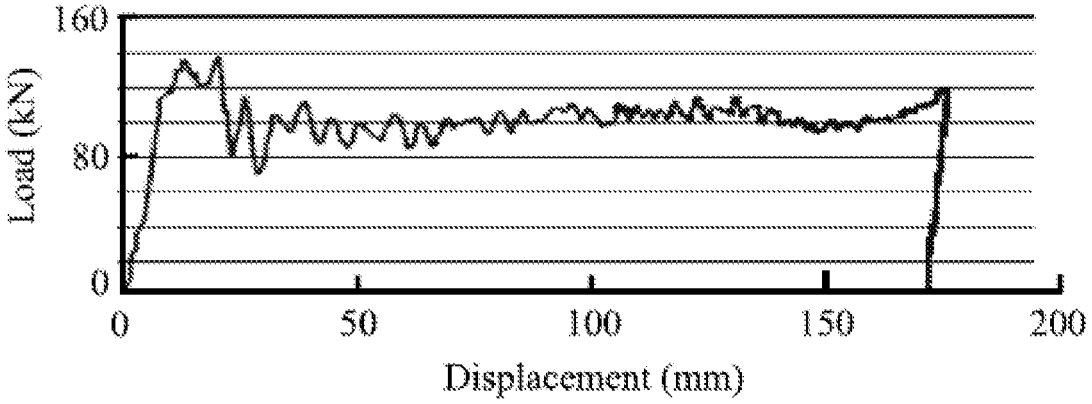
FIG. 9 is a graph showing the dynamic test result of the Yield-Lok™ rock bolt.
Figure 10:
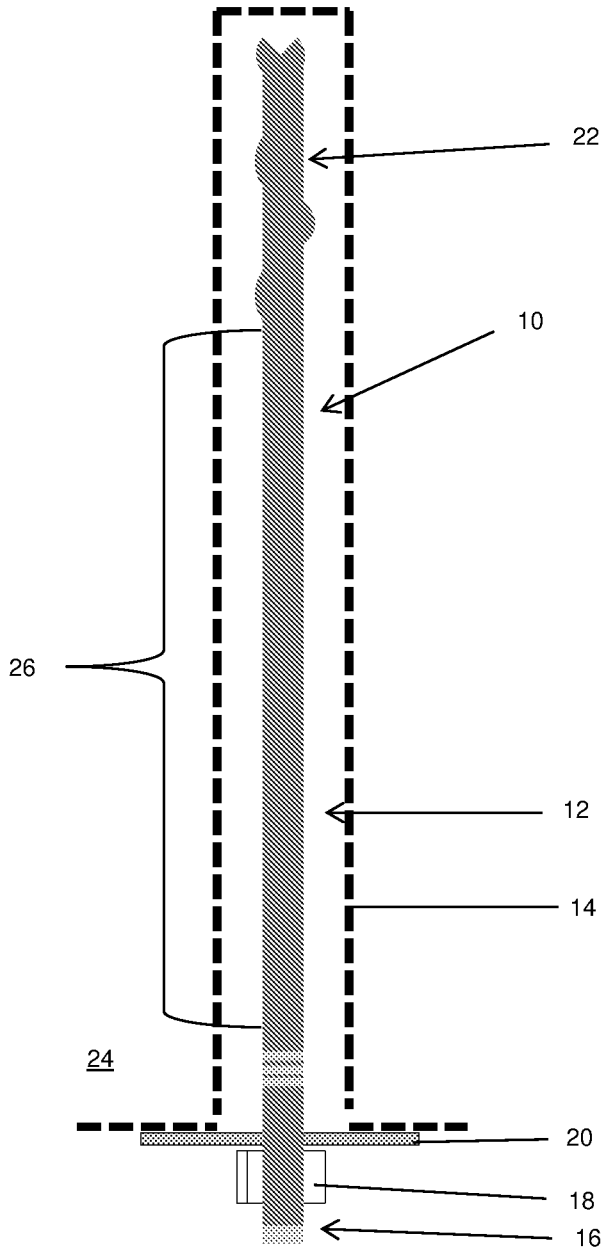
FIG. 10 is a plan view of a yielding rock bolt installed in the rock.

Referring to FIG. 10, a yielding rock bolt (10) including a threaded end (16) configured to receive a nut (18) and a bearing plate (20), and configured with a deformed paddle or profiled end (22). The rock bolt (10) is manufactured from and comprises manganese alloyed steel. The manganese content of the steel used to manufacture the rock bolt is preferably in the range 10 to 24%, more preferably in the range of 10 to 18%, or optimally 17%.

Figure 11:
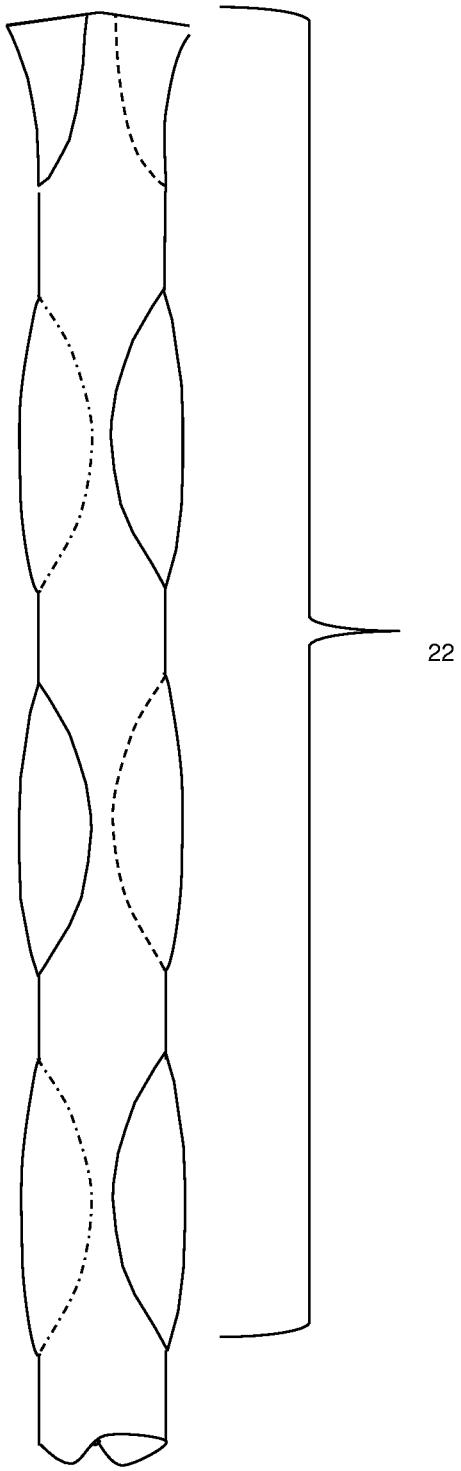
FIG. 11 is an enlarged view of a profiled end of an elongate body of the rock bolt.

The rock bolt (10) is installed into a drill hole (14) with resin grout (12). Upon installation, the profiled end (22) shown in FIG. 11 mixes the resin (12), thereby anchoring the rock bolt to the rock (24). The nut (18) is then tightened against the bearing plate (20) and subsequently tightened against the rock (24). This introduces a tensile load on the rock bolt (10) which supports the rock (24).

In the event of either static or dynamic movement of the rock (24) occurring in the direction of the bearing plate (20), which is the downward movement of the rock (24), the tensile load on the rock bolt (10) will increase. This results in the displacement of the manganese alloyed steel of the rock bolt (10). The displacement of the rock bolt (10) causes the diameter of the bolt (10) to be reduced in a smooth bar region (26) of the rock bolt (10) which instantaneously breaks the bond between the rock bolt (10) and the resin (12) along the length of the smooth bar region (26) of the rock bolt (10).

Figure 61:
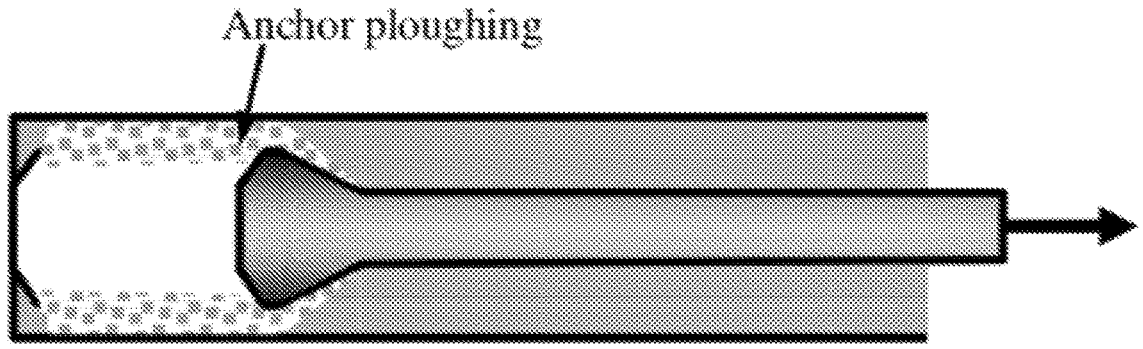
FIG. 61 is a drawing showing the effect of anchor ploughing of a rock bolt through an anchoring composition.

The rock bolt (10) includes one or more work-hardened zones (22, 16) defining a length of smooth bar region (26) therebetween. The work-hardened zones (22, 16) comprise the formation of deformed paddles (22) at the first end to facilitate mixing of the resin (12) and provide a larger surface area for bonding with the resin, while at the second end of the rock bolt (10), the work hardened zone comprises thread (16) formed on the bar for attachment of the bearing plate (20) and nut (18). The smooth bar region (26) instantaneously debonds from the resin (12) along the length of the smooth bar region (26) under the influence of a sudden dynamic load or static load. If successive shocks are applied or experienced, the smooth bar region deforms and decreases evenly in diameter with each shock, however the quantum of the extension becomes progressively less for each shock received. Under dynamic load conditions, the load capacity and displacement of the rock bolt increases until a point or threshold is reached at which the first end of the rock bolt is dislocated from the anchoring composition or dislocated from an anchor point at which the first end of the rock bolt is anchored in the rock. When this occurs, the first end starts anchor ploughing and the first end or anchor region of the rock bolt is dragged through the surrounding rock and/or resin which absorbs energy as the rock bolt is pulled out. The effect of anchor ploughing is illustrated in FIG. 61.

As a result of the above, the rock bolt (10) does not require any additional de-bonding means, such as a sleeve or wax layer, for ensuring the de-bonding between the rock bolt and the resin. The rock bolt (10) is also easier to install as a result of there being no moving parts or mechanical attachments other than the nut (18) and bearing plate (20).

This process will continue to take place along the smooth bar region (26) of the rock bolt (10) between the threaded end (16) and the profiled end (22) of the rock bolt (10).

The configuration of the rock bolt having two work hardened end regions and the smooth bar region therebetween, is specifically configured to be used with a rock bolt which is manufactured using the above manganese content. A rock bolt manufactured from any other material or combination of materials, which has the same configuration as described above, will not achieve the same level of success as the rock bolt of the invention. For example, a carbon steel rock bolt which includes the same configuration would not achieve the same success as the rock bolt of the invention because of the characteristics of the carbon steel.

Static Testing

In a first series of tests, 2 metre long bolts made from the manganese-alloy (Mn-alloy) steel were direct tensile tested. This was to determine the scalability of the short-gauge length tests and to establish a base-line for performance of the bolts when grouted into simulated holes with resin.

Test specimens were prepared for the first series of tests. These comprised 25 millimetres diameter smooth bar region of the Mn-alloy steel cut to 2 m lengths and threaded for 150 mm at each end for gripping in the test machine. This left a test gauge length of 1700 mm.

Tensile Testing was performed at a Mechanical Engineering laboratory of The Council for Scientific and Industrial Research (CSIR), using a Mohr & Federhaff 500 tonne direct tensile testing machine. The machine is manually controlled to the desired deformation rate. Data acquisition relating to load and deformation is automatic and directly stored digitally.

Specimen A of the first series was tested at 134 (±2) mm/minute. This was reduced to 90 mm/minute for testing specimens B-D, in order to achieve approximately the same strain rate as achieved when testing full-length conventional rock bolts.

For the first series of test, two nuts were threaded onto each end of the bolt, which was then mounted in the testing machine so that the tensile load was transmitted via the nuts to the bolt. Referring to FIG. 12, each bolt displaced uniformly over its full length. For specimens A-C, the displacement increased steadily until failure. Referring to FIG. 13, specimen D was loaded to 100 kilonewtons (kN) and the load held while diameter was measured at three points (positions 1 to 3). Position 1 and 3 which were approximately 500 mm away on each side of position 2 which was approximately central on the bolt. The diameter measurement was repeated at 200 kN and 300 kN. The test was stopped at 350 kN and the specimen unloaded so that post-loading displacement and diameter reduction could be measured on an intact bolt. After unloading from 350 kN which was about 90% of failure load, there was a small recovery of both length and diameter but most of the deformation was permanent. When loading was stopped at 100, 200 and 350 kN there was no fall-off of load. Each specimen bolt failed on the threads. Up to 350 kN, diameter reduction of approximately 2 mm was equally spread over the gauge length, with no evidence of "necking down". FIG. 59 illustrates the effect on a rock bolt described as necking down, and also illustrates the uniform diameter reduction described above.

Figure 14:
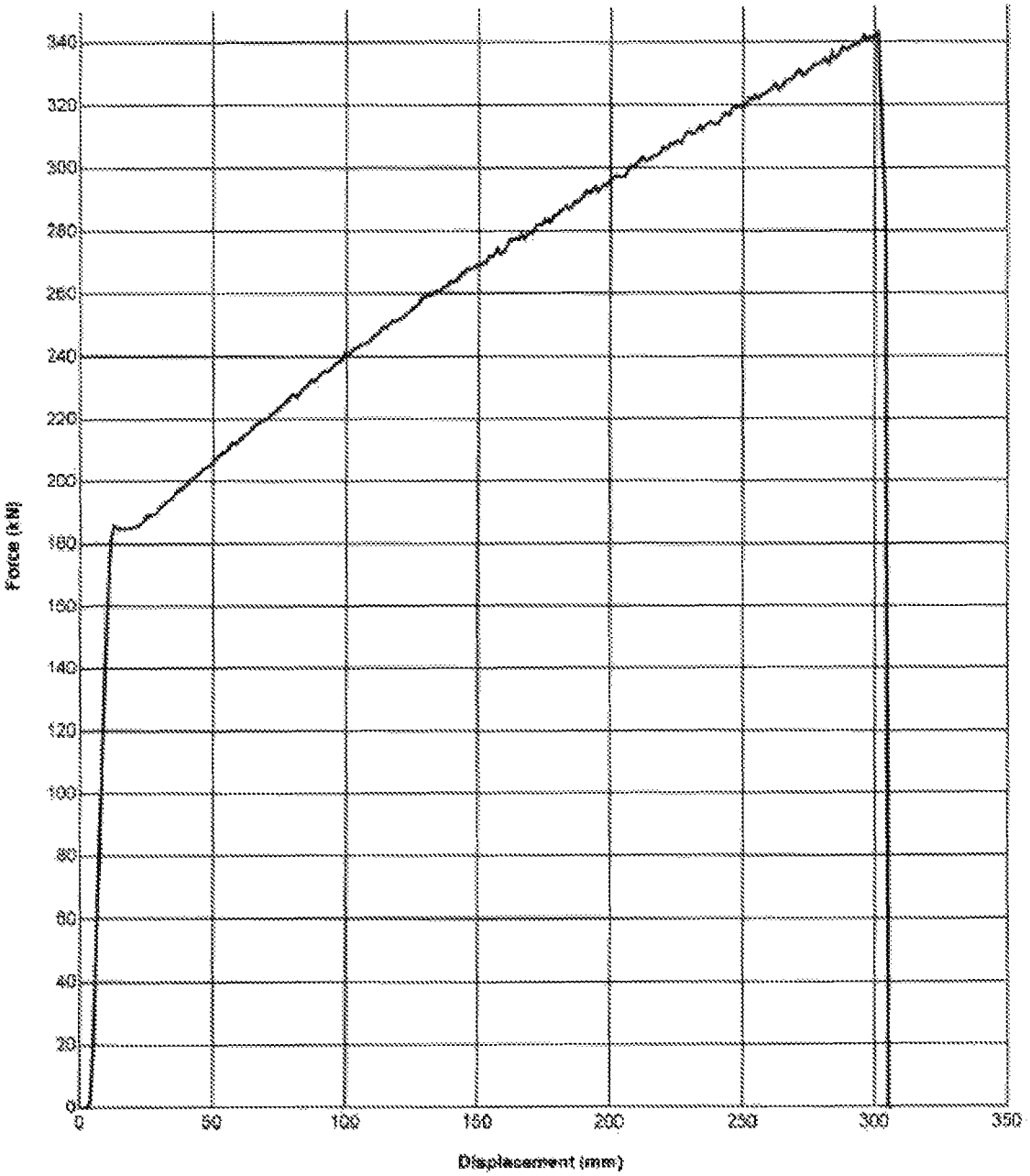
FIG. 14 is a graph depicting the typical deformation load or curve observed when direct tensile testing specimen A during the first series of static testing of the rock bolt of the invention.

Referring to the graph in FIG. 14, when direct tensile testing specimen A, above 180 kN of force, the displacement in mm increases substantially evenly as the force or load is increased. The maximum displacement achieved is approximately 300 mm.

In a second series of tests, tensile tests were performed on 2.15 m bolts, grouted into heavy-wall steel tubes to simulate rock bolts grouted into holes in rock. The second series of tests were divided into "double embedment" and "direct pull" tests, as shall be described below.

The following test specimens were prepared for the second series of tests:

a. Bolts comprising 25 mm smooth bar region of Mn-alloy steel, with deformed paddle formations over the last 350 mm, wherein the deformation height was 29 mm, and threaded 150 mm at the other end. The bolts were not fitted with any de-bonding layer over the yielding section. Prior to installation, the anchor end of each bolt was cleaned.

b. Steel pipes which were 2 m long, having an outer diameter of 50 mm, and an inner diameter of 36 mm, with the last 350 mm at each end machined to form a coarse internal thread. One end of each pipe was sealed by welding on a steel cap.

c. Resin capsules, being 32 mm in diameter, 600 mm in length having a 60 second set time, which were located at back of the pipe, as well as 32 mm in diameter, 900 mm in length having a 5-10 min set time which were used for the balance of the length.

The bolts were installed on a resin test laboratory installation test bed. The installation parameters were:

a. Rotation: 250-300 rpm, left hand;

b. Feed (i.e. bolt installation rate): 21 s/m, with a total time of 45 seconds from commencement of installation to the end of spinning.

After each installation the made-up specimen was left for 1 minute on the installation rig, for the resin to harden, after which they were removed. The installations were performed two days before the tests were conducted, so the resin had 48 hours to cure. The first installation failed as the bolt slipped in the jaws of the installation rig chuck. The remaining 9 installations were consistent and successful.

After installation, 5 specimens were further prepared for "double embedment" testing by splitting the pipe circumferentially at 1150 mm from the anchor end.

For the double embedment tests, a small plate was fitted over the exposed bolt threads on each bolt and the nut tightened up against the end of the pipe. This simulated the effect of a washer-plate in underground installations. Each end of the split pipe was gripped in gripper jaws on the testing machine. The two portions of pipe were then pulled apart, simulating deformation across a joint in the rock.

Figures 15, 16:
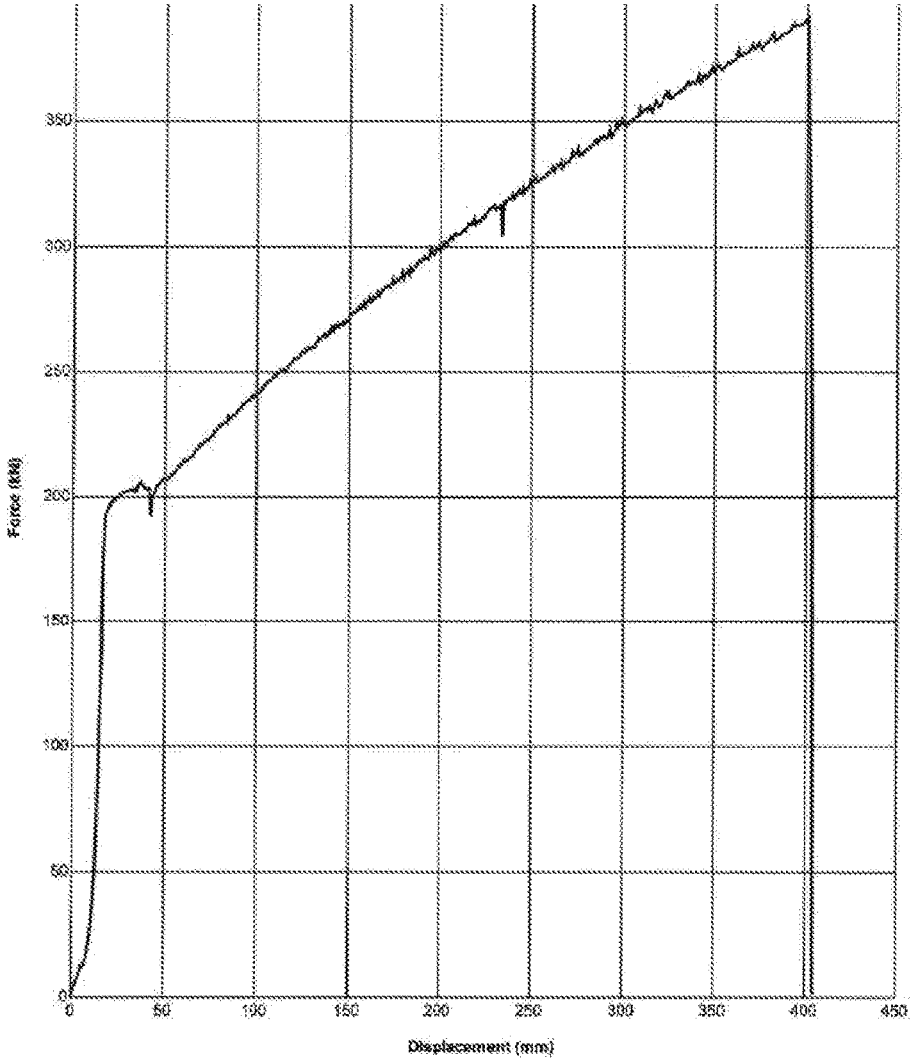
FIG. 15 shows the results of the double embedment tests carried out on 5 specimens (specimens 2-6) during the second series of static testing of the rock bolt of the invention.
FIG. 16 is a graph depicting the typical deformation load or curve observed when double embedment testing specimen 5 during the second series of static testing of the rock bolt of the invention.

Referring to FIG. 15, the bolts behaved consistently across the 5 specimens tested. None of the resin anchor-ends failed. The steel of the bolt de-bonded from the surrounding resin and displaced uniformly along the full test gauge length. All bolts achieved at least 380 mm of displacement, with peak load exceeding 370 kN. Failure was on the threads or within the pipe, near to the first deformed paddle formation.

Referring to the graph shown in FIG. 16, the displacement of specimen 5 increases substantially evenly as the force or load increases above 200 kN. The maximum displacement achieved is approximately 400 mm.

Figures 17, 18:
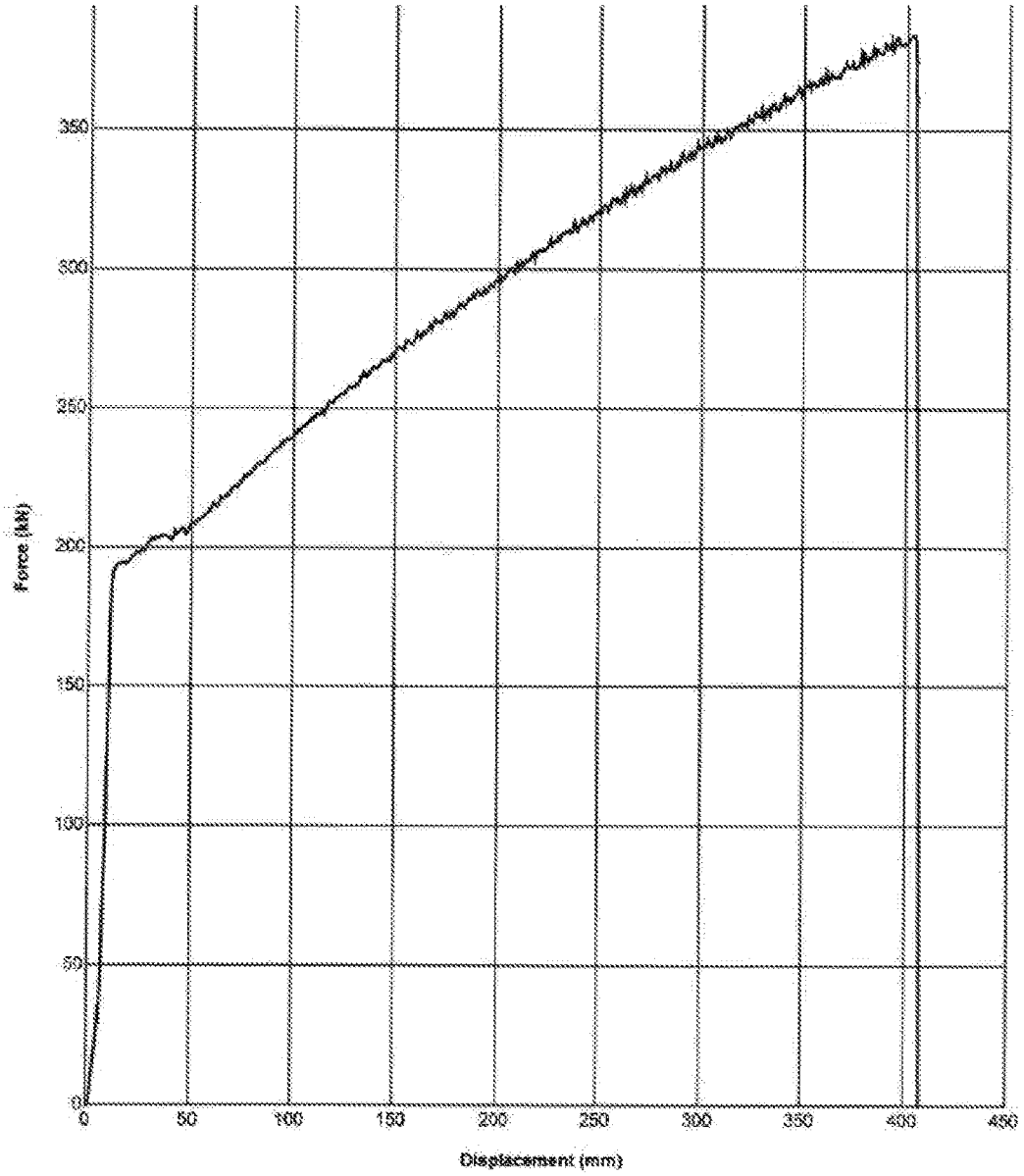
FIG. 17 shows the results of the direct pull tests carried out on 3 specimens (specimens 7-9) during the second series of static testing of the rock bolt of the invention.
FIG. 18 is a graph depicting the typical deformation load or curve observed when pull testing specimen 9 during the second series of static testing of the rock bolt of the invention.
Figure 22:
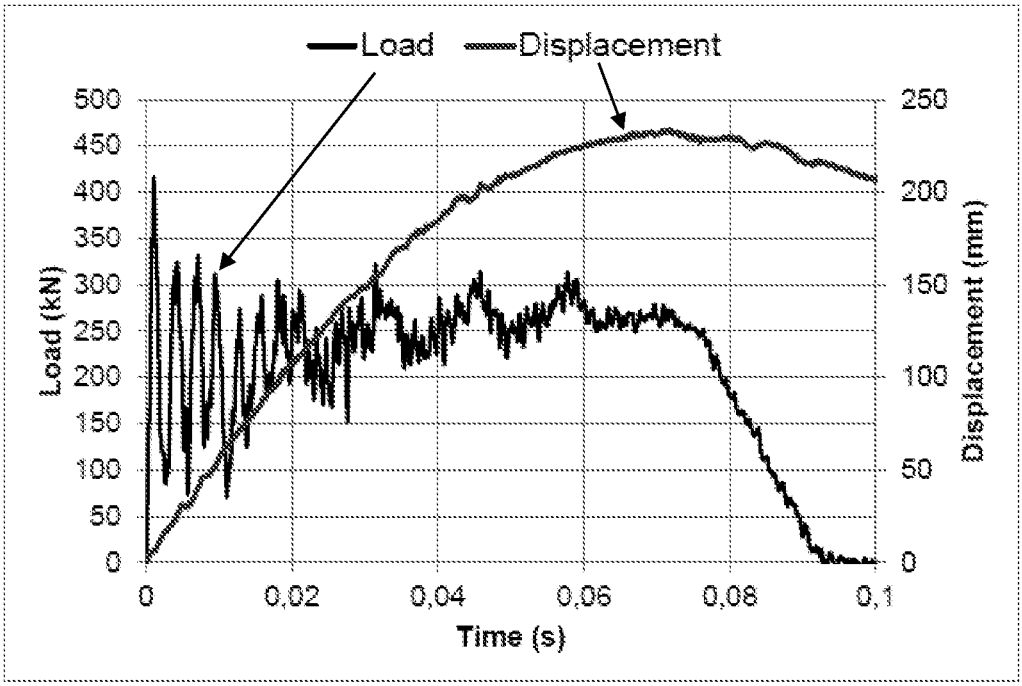
FIG. 22 is a graph depicting the results of test 1, a dynamic drop test conducted on a sample rock bolt of the invention which was grouted into a continuous tube.
Figure 23:
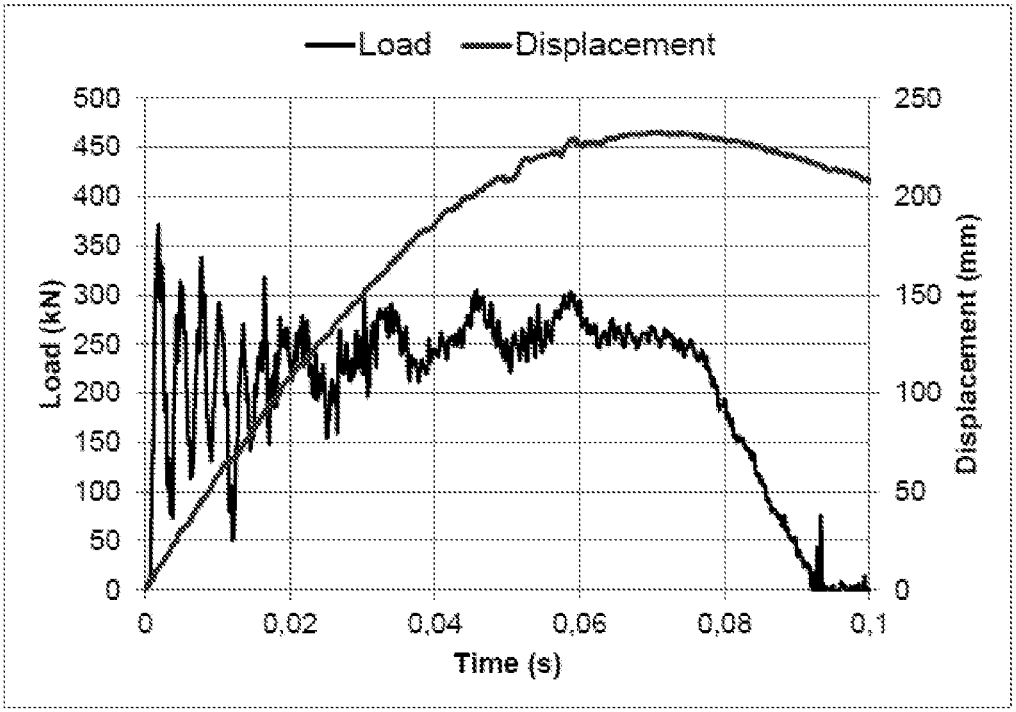
FIG. 23 is a graph depicting the results of test 2, a dynamic drop test conducted on a sample rock bolt of the invention which was grouted into a continuous tube.
Figure 24:
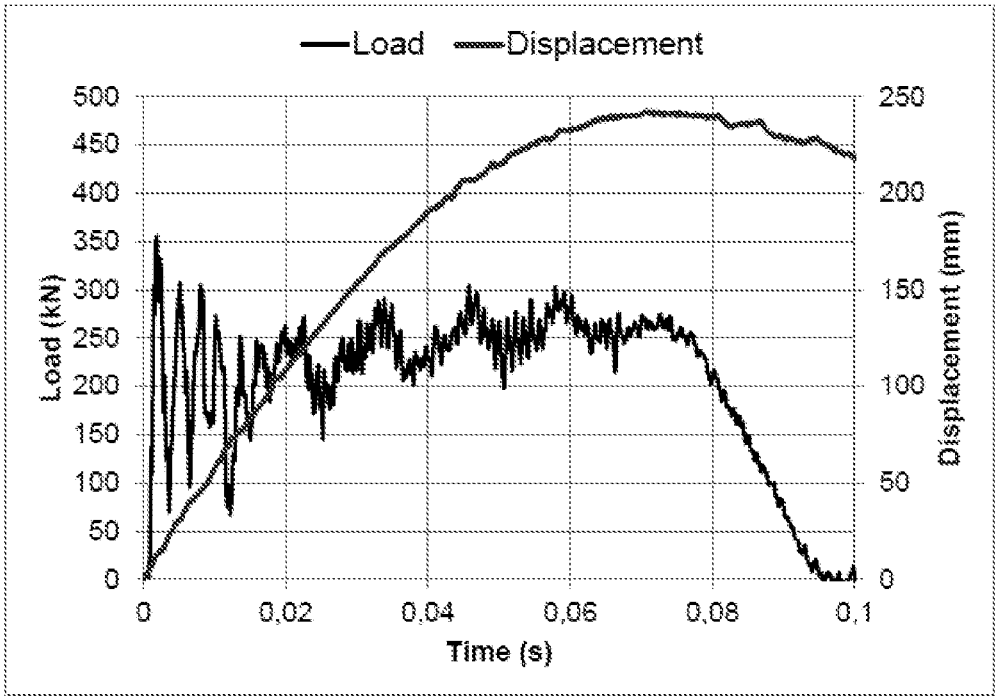
FIG. 24 is a graph depicting the results of test 3, a dynamic drop test conducted on a sample rock bolt of the invention which was grouted into a continuous tube.
Figure 25:
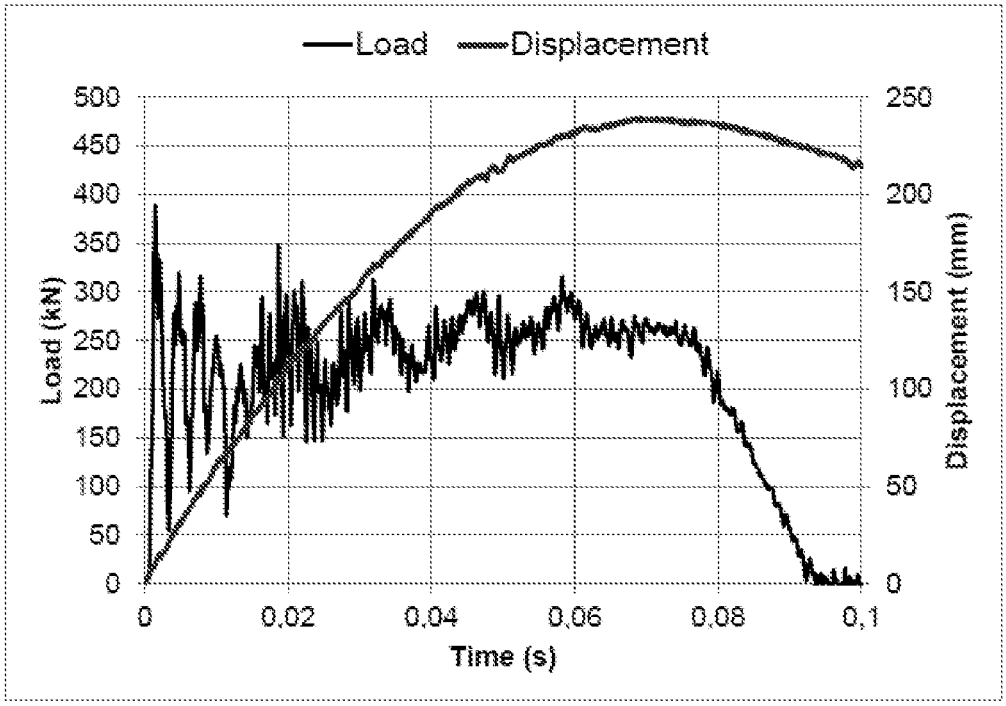
FIG. 25 is a graph depicting the results of test 4, a dynamic drop test conducted on a sample rock bolt of the invention which was grouted into a continuous tube.
Figure 28:
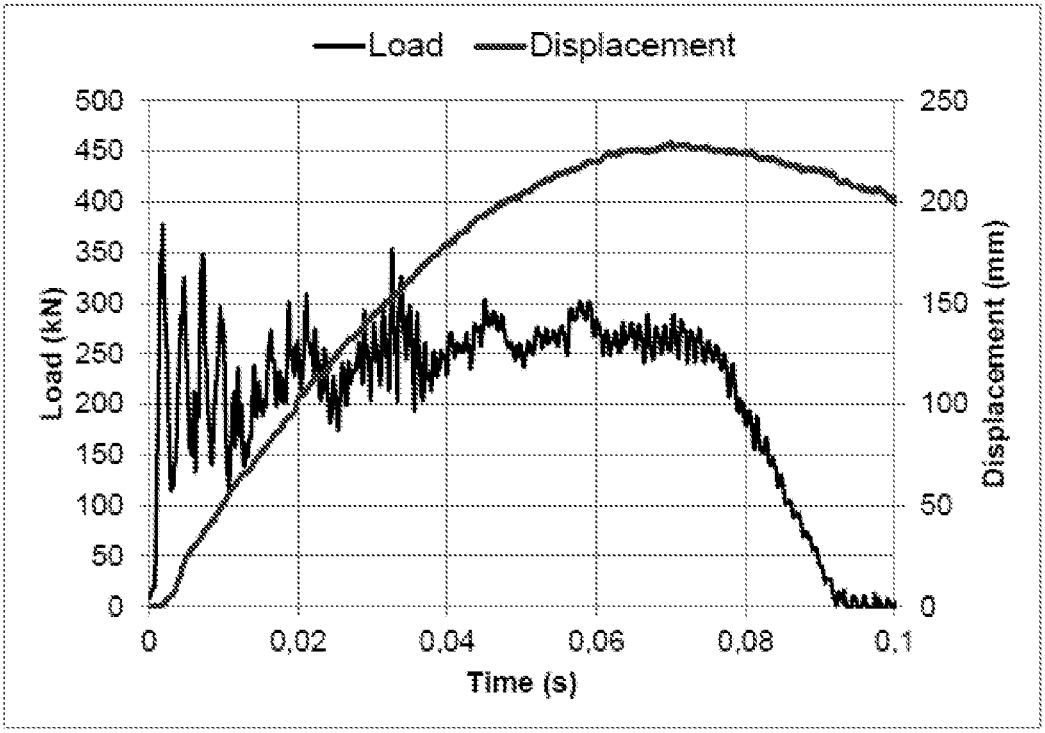
FIG. 28 is a graph depicting the results of test 6, a dynamic drop test conducted on a sample rock bolt of the invention which was grouted into a split tube.
Figure 29:
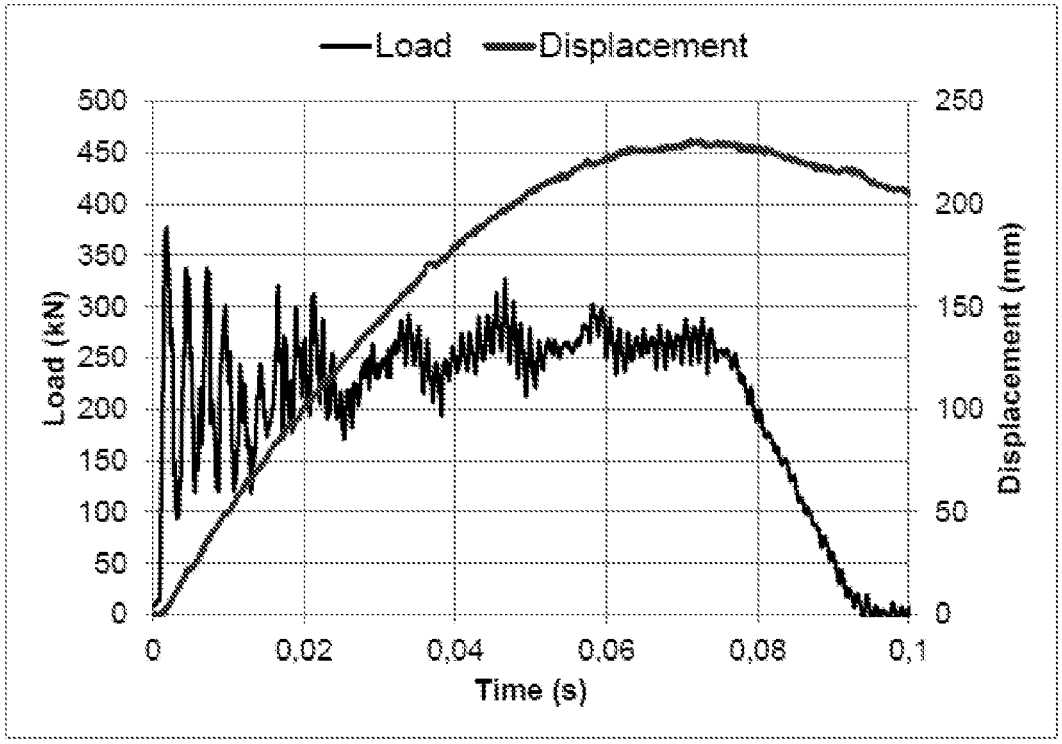
FIG. 29 is a graph depicting the results of test 7, a dynamic drop test conducted on a sample rock bolt of the invention which was grouted into a split tube.
Figure 30:
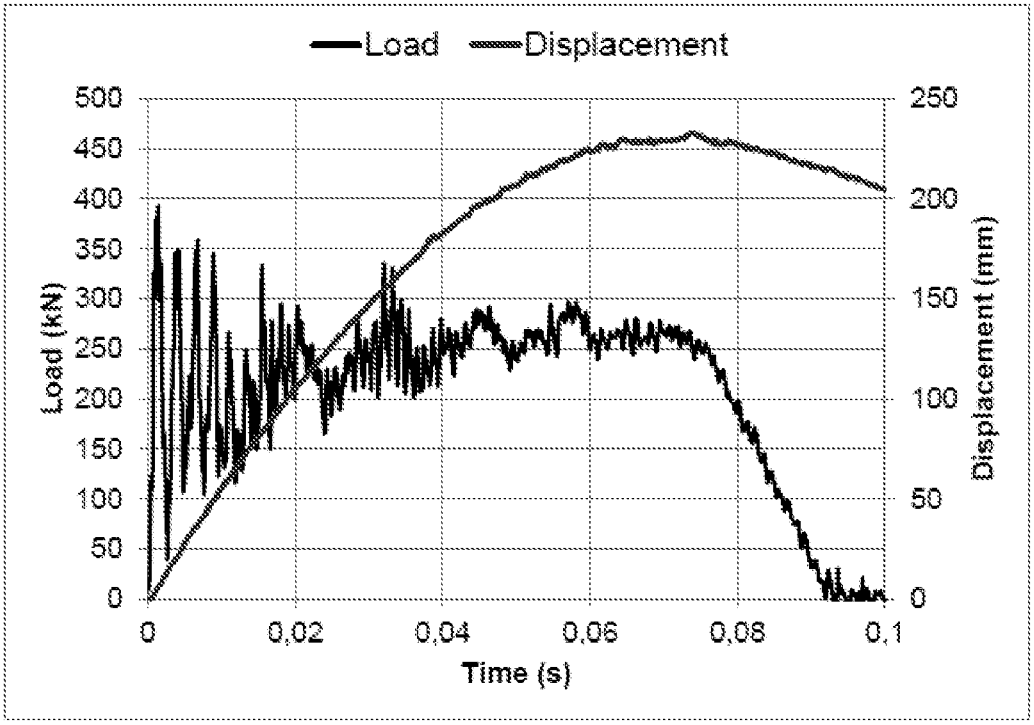
FIG. 30 is a graph depicting the results of test 8, a dynamic drop test conducted on a sample rock bolt of the invention which was grouted into a split tube.
Figure 31:
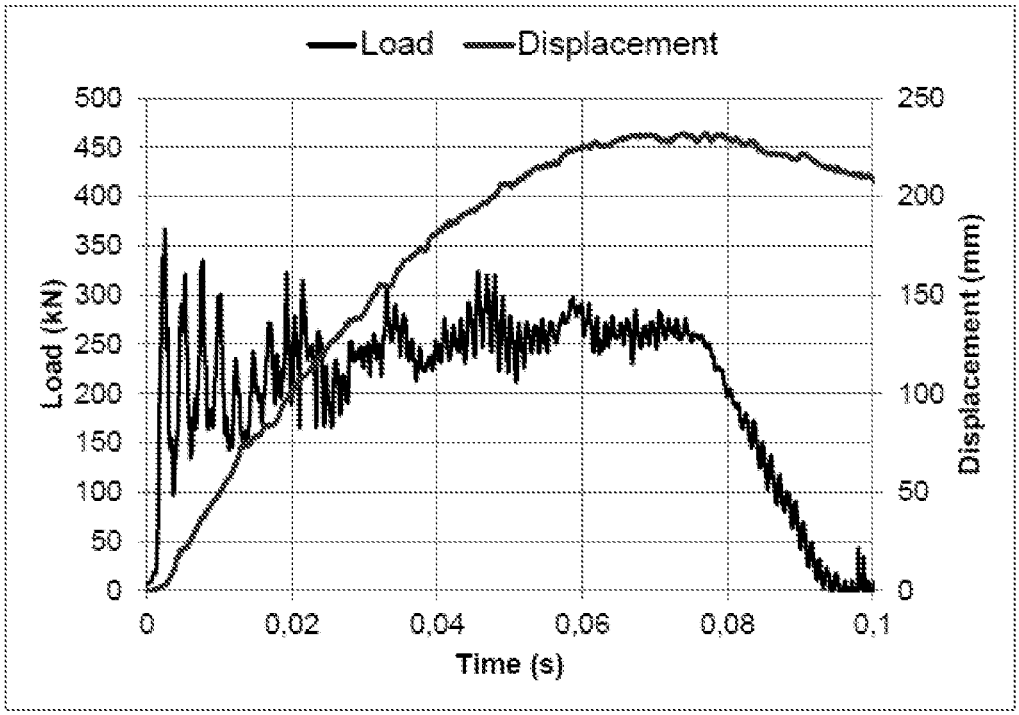
FIG. 31 is a graph depicting the results of test 9, a dynamic drop test conducted on a sample rock bolt of the invention which was grouted into a split tube.

For the direct pull tests, the anchor end of each pipe was held in gripper jaws and the free end of the bolt pulled out by a testing machine. Referring to FIG. 17, each of the bolts displaced in a similar way to the double embedment tests. The bolt de-bonded from the resin and the free end of the bolt pulled out of the pipe by at least 350 mm. None of the resin anchor-ends failed.

Referring to the graph shown in FIG. 18, the displacement of specimen 9 increases substantially evenly as the force or load increases above 200 kN. The maximum displacement achieved is approximately 400 mm.

The tests determined that the rock bolt forms a highly successful yielding rock bolt system when used in conjunction with resin capsules for grouting the bolts into the rock.

Figure 60:
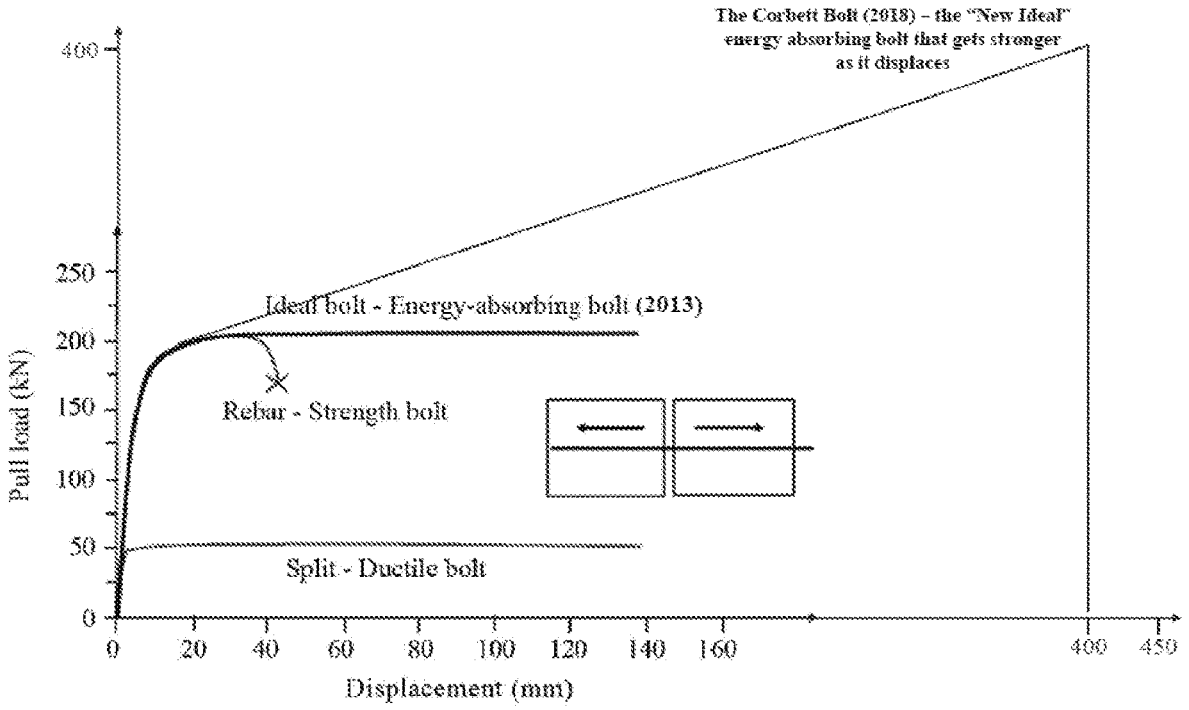
FIG. 60 is a graph showing the load capacity and displacement characteristics of typical prior art rock bolts and the rock bolt of the current invention also referred to as The Corbett Bolt.

Given its unique strengthening and displacement characteristics, the rock bolt absorbs significantly more energy than the energy absorption achieved by a traditional steel rock bolt, as illustrated in FIG. 60. It should be noted that the criteria for ideal may change due to the introduction of The Corbett Bolt into the market, which demonstrates preferred characteristics and improved performance, and gets stronger and it displaces.

Referring to FIG. 19, the energy absorbed in kJ ranged between 75 and 99 when the first series of tests were being conducted. The energy absorptions were slightly underestimated as the area under the load-deformation curve was approximated by a rectangle and a triangle, both lying inside of the actual curves.

FIG. 20 shows that the energy absorptions were between 107 and 118 kJ for the specimens tested during the double embedment testing. Referring to FIG. 21 the energy absorbed during the direct pull-out tests was between 103 and 111 kJ.

Furthermore, the energy absorption of bolts embedded in resin was consistently higher than for the bolts alone, despite a shorter yield portion of the embedded bolts. This indicated that the deformation of the anchor portion contributes to energy absorption and/or the interaction between the bolt and the resin also contributes to energy absorption. The same would apply if cementitious grout is used or an anchor mechanism such as an expansion shell.

Dynamic Testing

Dynamic testing differs from static testing in that dynamic testing investigates the load capacity and deformation of the rock bar by applying a greater and quicker impact load to the rock bolt, in order to test the performance of the rock bolt in fast moving rock conditions. Static testing on the other hand tests the performance of the rock bolt in what would be considered slow moving rock conditions.

Dynamic drop tests were conducted on the rock bolt of the invention by Glowny Instytut Gornictwa (GIG) testing and calibration laboratories (Laboratory of mechanical device testing) in Poland. These were carried out in order to inspect the resistance of the rock bolt to dynamic loading at a load impact energy (E) value of 50.85 kJ, and at an impact velocity (v) of 6.0 metres/second (m/s). The above values being typical industry testing criteria for rock bolts.

The rock bolts tested were 2250 mm in length, with a thread of 150 mm and the bolt diameter being 25 mm. The rock bolt included the deformed paddle section of 350 mm, a yielding section of 1750 mm and the threaded section of 150 mm.

Figure 62:
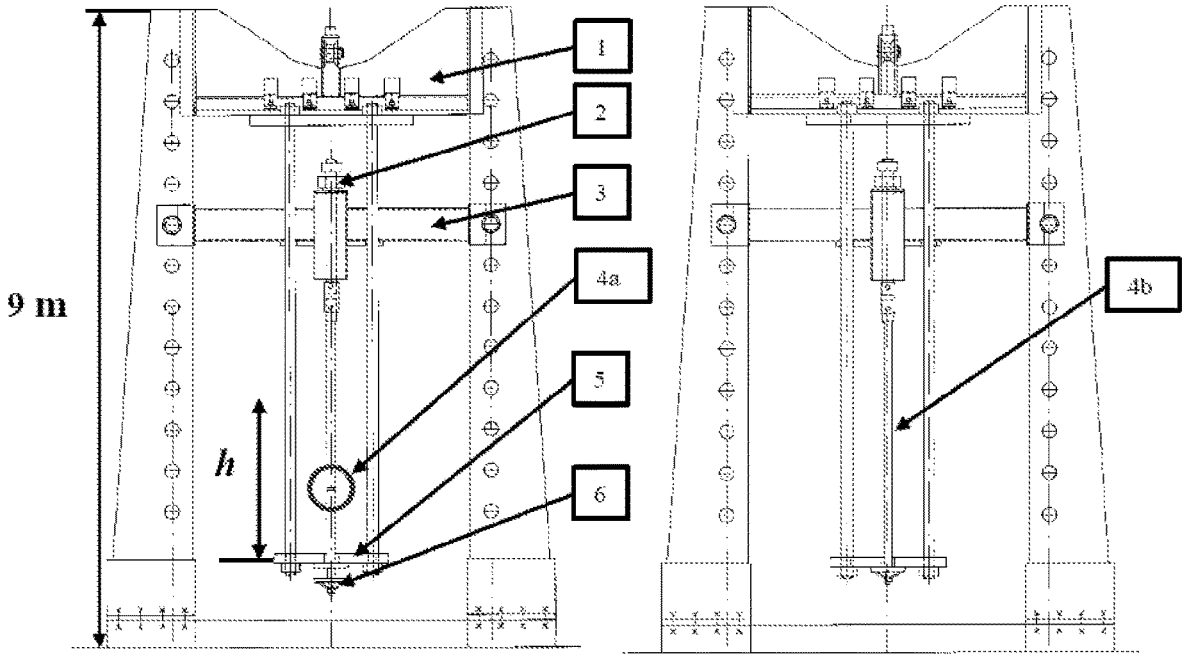
FIG. 62 are drawings which show the diagrams of the workstation used to conduct the dynamic load tests of the rock of the invention.

The rock bolts were either grouted into a continuous 2 100 mm long tube (load case 2), or grouted into a 2 100 mm long tube which was split (load case 1) at a proportion of 1 225 mm (upper tube section)/875 mm (lower tube section) or ratio of 1225 mm: 875 mm. The grouted rock bolts were then mounted on the testing workstation and tested. The workstation is represented in FIG. 62, drawing (a) shows the workstation diagrams during testing of rock bolts grouted into a split tube, and drawing (b) shows the workstation diagrams during testing of rock bolts grouted into a continuous tube, and wherein:

1-drop mass
2-force sensor
3-beam for rock bolt fastening
4*a*-rock bolt grouted into a split tube (for load case 1 tests)
4*b*-rock bolt grouted into a continuous tube (for load case 2 tests)
5-impact plate
6-bolt base and nut The impact energy (E) and the impact velocity (v) were determined using the following formula:

$$E = \frac{mgh}{1000}, \text{kJ}$$

$$v = \sqrt{2gh}, \text{m/s}$$

wherein:
m-drop mass, kilograms (kg)
h-drop height, metres (m)
g-gravitational acceleration equalling 9.81 m/s$^2$ The drop mass (m) was raised to a determined height (h) which corresponded to the given impact energy (E) and load velocity (v), wherein:

in load case 1: E=50.85 kJ and v=6.0 m/s, which corresponded with m=2825 kg and h=1 835 mm; and
in load case 2: E=50.85 kJ and v=6.0 m/s, which corresponded with m=2825 kg and h=1 835 mm.

The mass (m) was allowed to drop or free fall from the height (h) onto:

the base of the rock bolt grouted into the continuous tube
the base welded to the tube 50 mm above its end.

During the testing, the measurement data was registered at a sampling rate (f) of 19.2 kilohertz (kHz). The measured factors were the load (F) imposed on the bolt and the displacement (L) as a function of time (t). The graphs were used to determine the value of the first force peak ($F_1$) and the maximum load value ($F_{max}$) imposed on the rock bolt.

After testing the rock bolt which had been grouted into a split tube, further measurements were used to inspect the parting length of the gap between the upper and lower sections of the tube. The force measurements were carried out via a strain gauge sensor, while the displacement measurements were carried out via laser sensor. The sensors were connected to an HBM MGCplus-type measuring amplifier, which worked in cooperation with a computer that registered the measurement data.

In a first series of tests (tests 1 to 10), each bolt (sample ID 1 to 10) was subjected to a single impact.

The results for the single impact dynamic drop tests 1 to 5, which concerned the rock bolts in continuous tubes (load case 2), are represented in the graphs of FIGS. 22 to 26, and the table of FIG. 27. The first force peaks ($F_1$) and max load ($F_{max}$) ranged between 355.5 and 416.3 kN. The total displacement after these tests ($L_{max}$) ranged between 202 and 211 mm. The diameter was reduced from 25 mm to a range of between 23.5 and 23.7 mm. Therefore displacement of approximately up to 10% of the entire bolt was observed across the rock bolts of tests 1 to 5. The tests included rock bolts with 2 nuts (tests 1 and 2) as well as rock bolts with 1 nut (tests 3 to 5). In all tests 1 to 5, the rock bolt was not destroyed and the nut/s were free running after the testing.

Figures 32, 33:
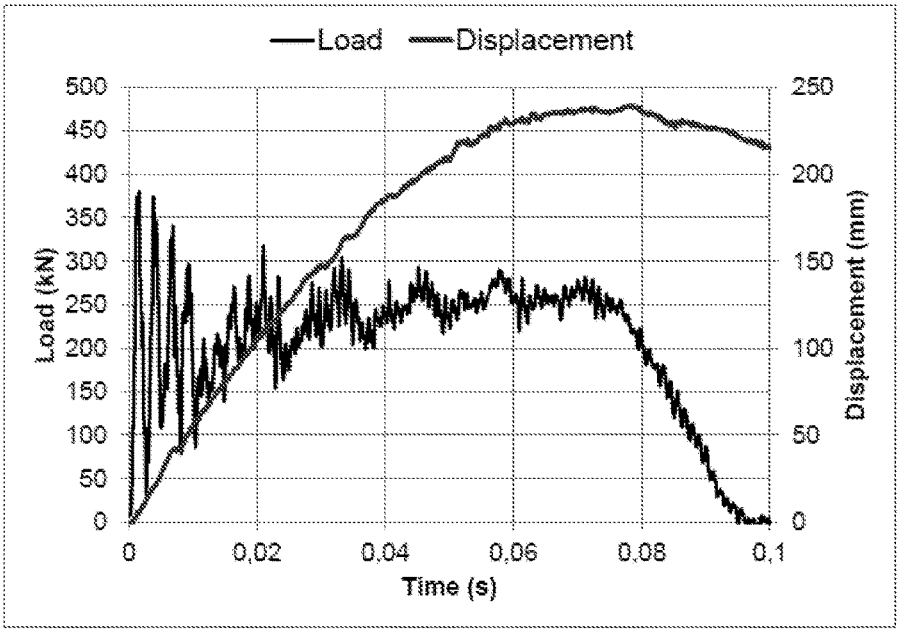
FIG. 32 is a graph depicting the results of test 10, a dynamic drop test conducted on a sample rock bolt of the invention which was grouted into a split tube.
FIG. 33 is a table showing the results of tests 6 to 10, dynamic drop tests conducted on the sample rock bolts of the invention grouted into continuous tubes.
Figure 34:
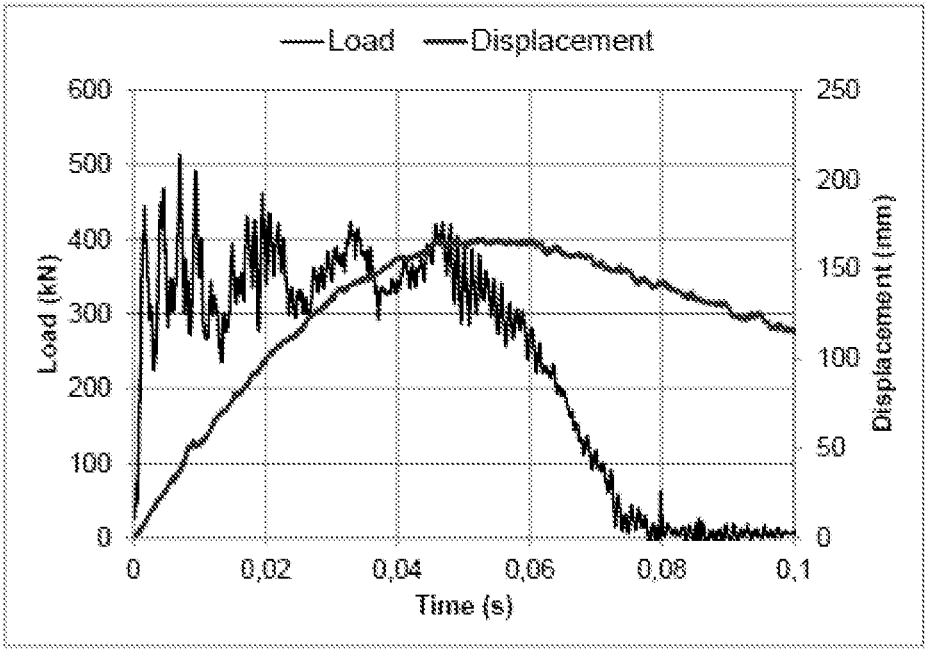
FIG. 34 is a graph depicting the results of test 11, a $2^{nd}$ drop test conducted on the rock bolt after test 1.
Figure 35:
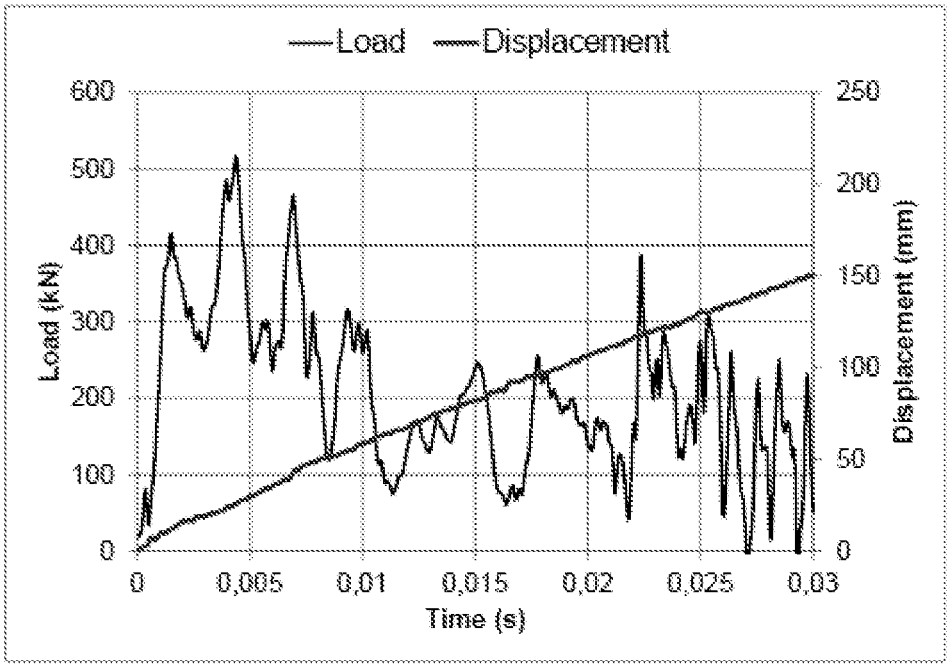
FIG. 35 is a graph depicting the results of test 12, a $3^{rd}$ drop test conducted on the rock bolt after test 11.
Figure 36:
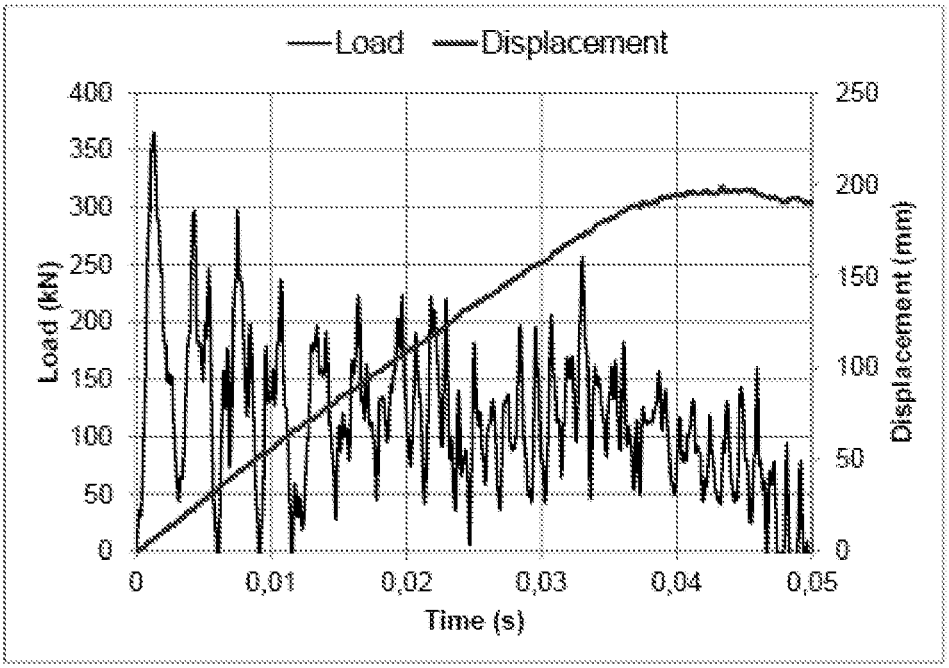
FIG. 36 is a graph depicting the results of test 13, a $4^{th}$ th drop test conducted on the rock bolt after test 12.
Figure 37:
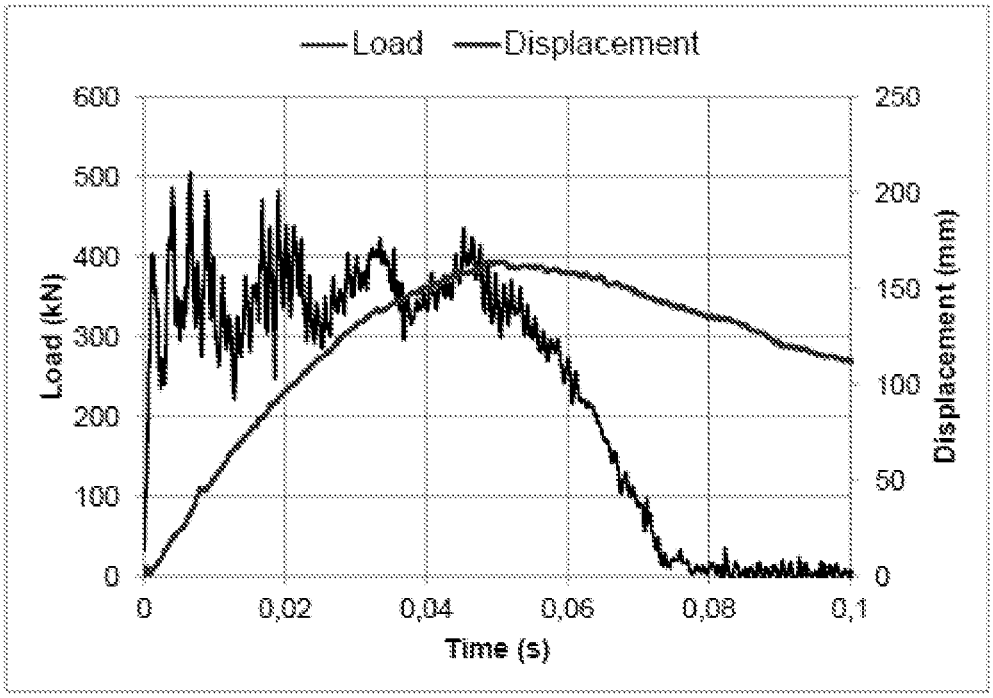
FIG. 37 is a graph depicting the results of test 14, a $2^{nd}$ drop test conducted on the rock bolt after test 2.
Figure 38:
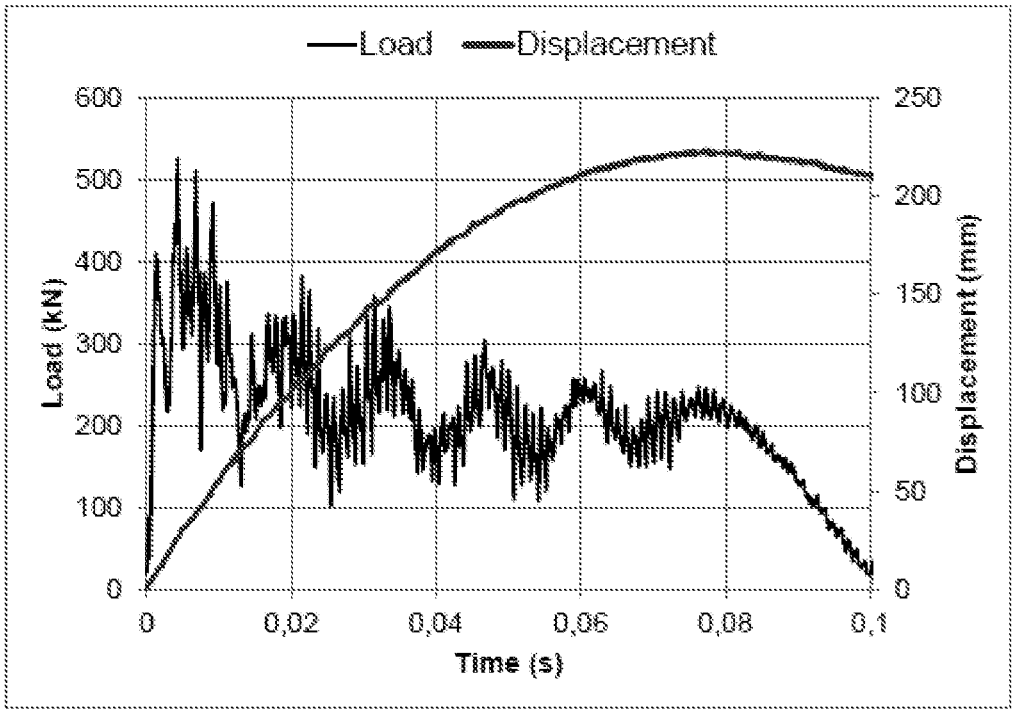
FIG. 38 is a graph depicting the results of test 15, a $3^{rd}$ drop test conducted on the rock bolt after test 14.
Figure 39:
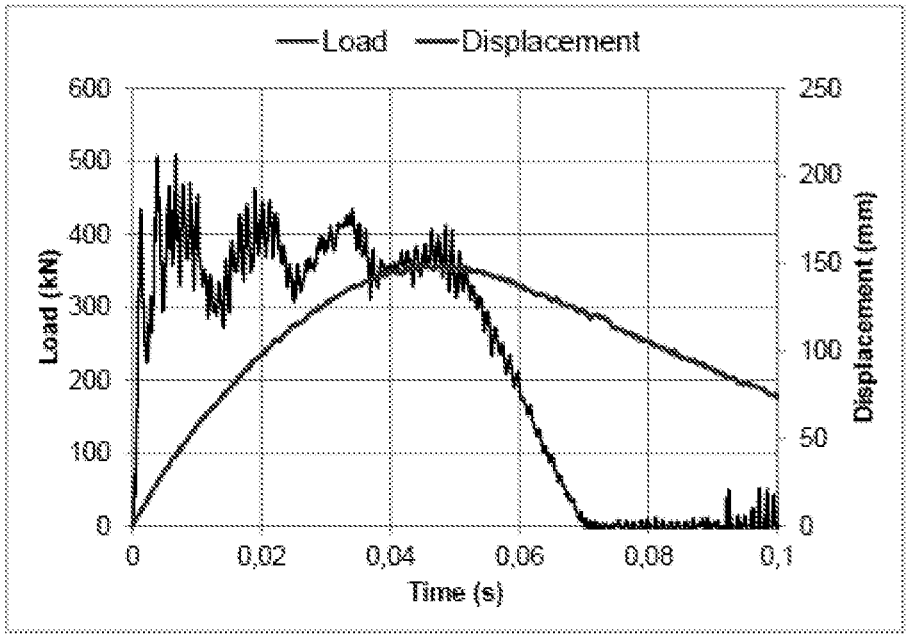
FIG. 39 is a graph depicting the results of test 16, a $4^{th}$ drop test conducted on the rock bolt after test 15.
Figure 40:
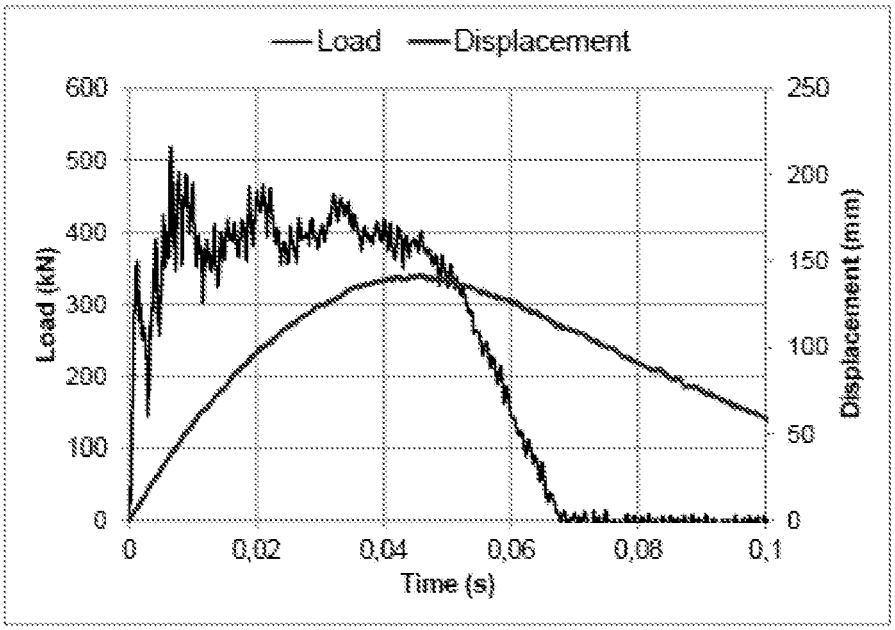
FIG. 40 is a graph depicting the results of test 17, a $5^{th}$ drop test conducted on the rock bolt after test 16.
Figure 41:
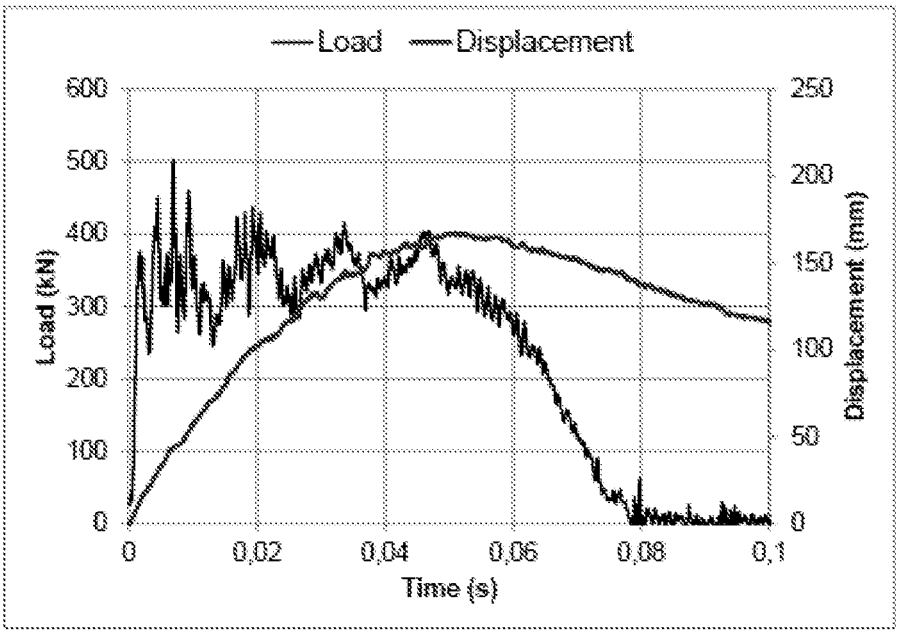
FIG. 41 is a graph depicting the results of test 18, a $2^{nd}$ drop test conducted on the rock bolt after test 3.
Figure 42:
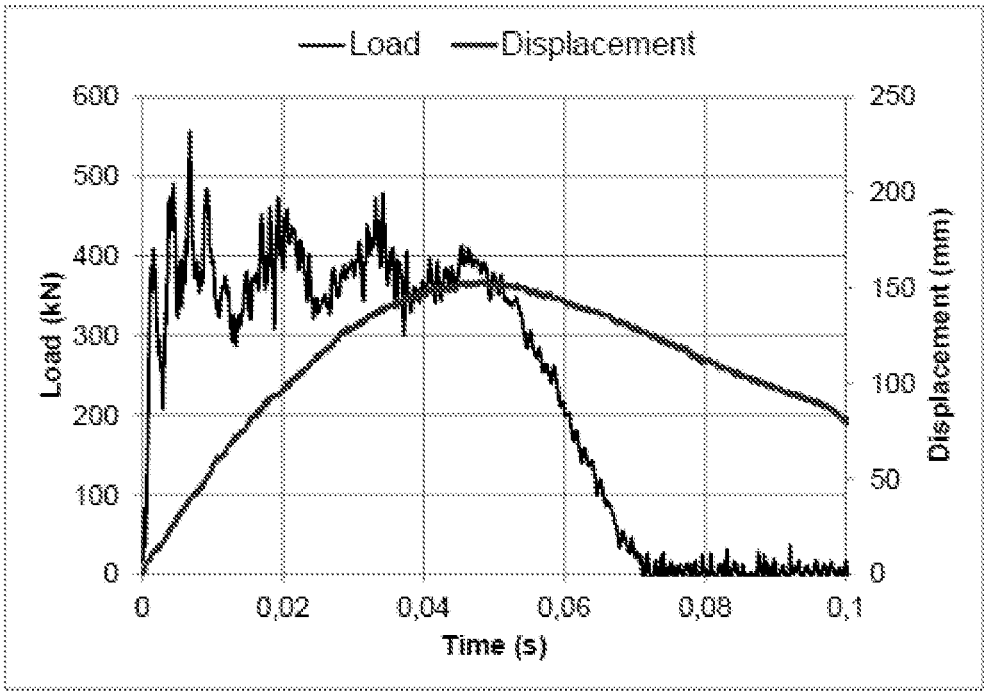
FIG. 42 is a graph depicting the results of test 19, a $3^{rd}$ drop test conducted on the rock bolt after test 18.
Figure 43:
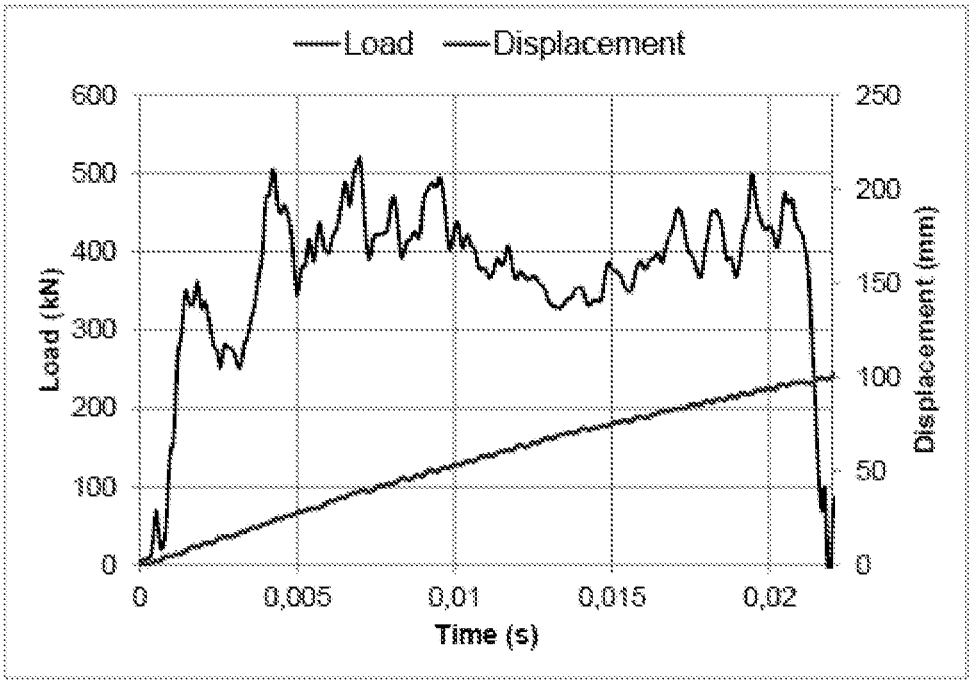
FIG. 43 is a graph depicting the results of test 20, a $4^{th}$ drop test conducted on the rock bolt after test 19.
Figure 44:
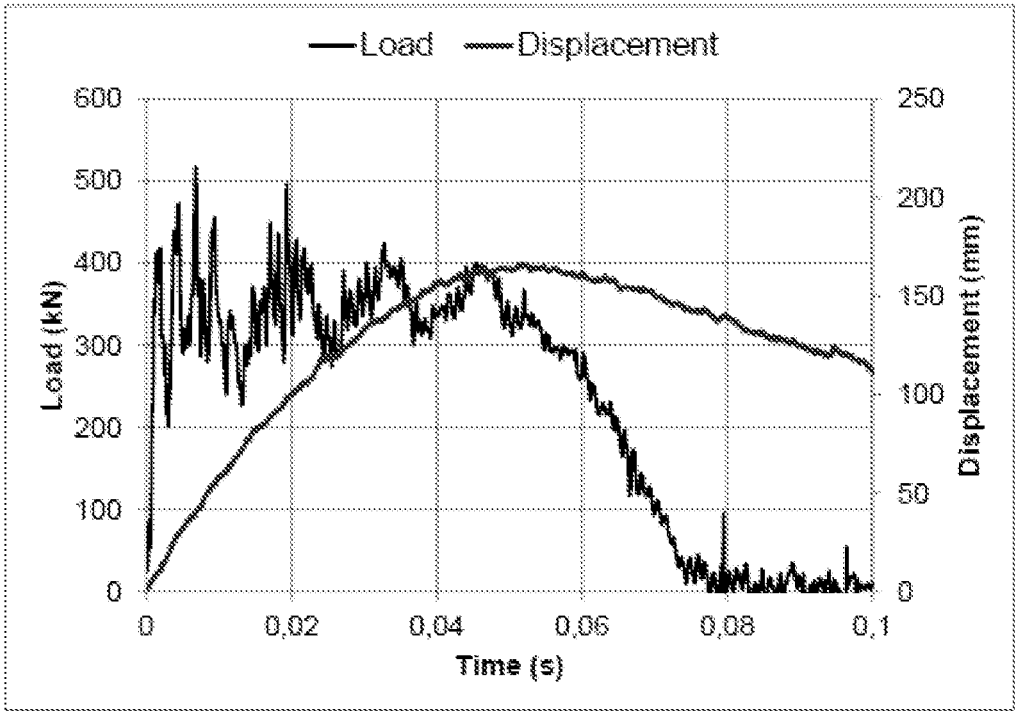
FIG. 44 is a graph depicting the results of test 21, a $2^{nd}$ drop test conducted on the rock bolt after test 4.
Figure 45:
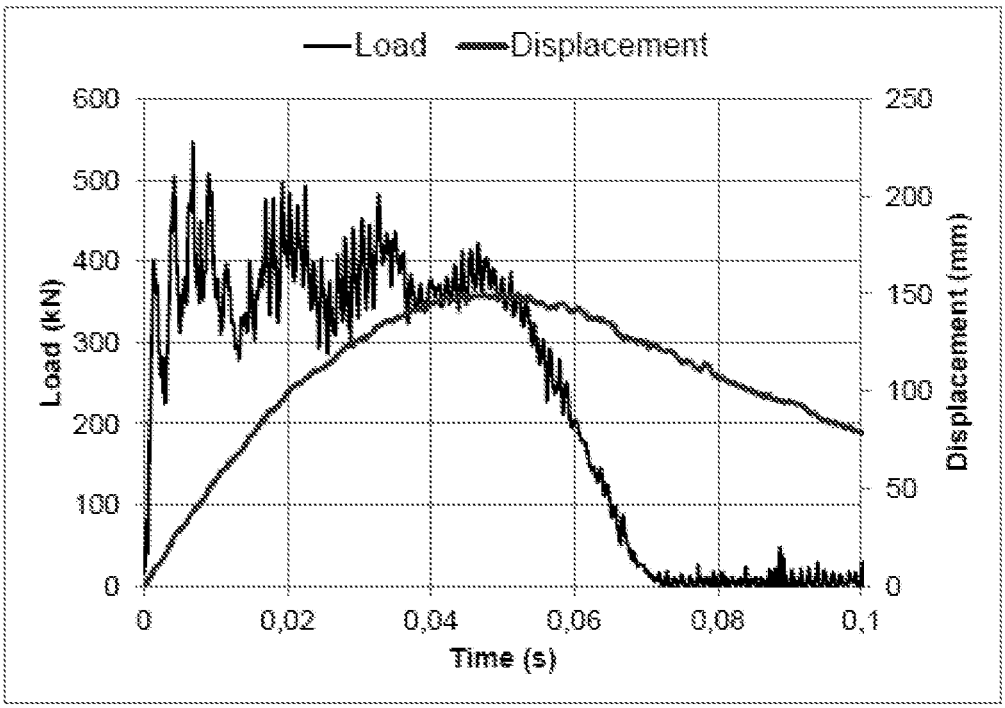
FIG. 45 is a graph depicting the results of test 22, a $3^{rd}$ drop test conducted on the rock bolt after test 21.
Figure 48:
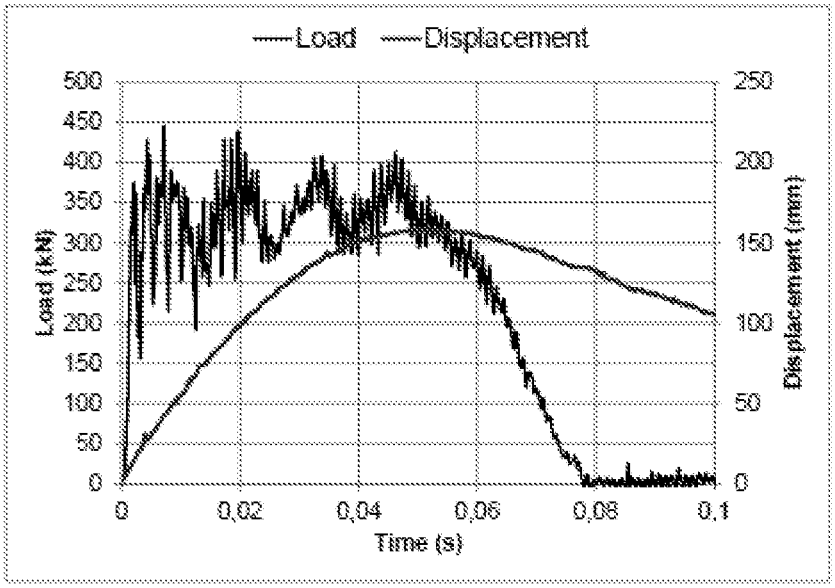
FIG. 48 is a graph depicting the results of test 24, a $2^{nd}$ drop test conducted on the rock bolt after test 8.
Figure 49:
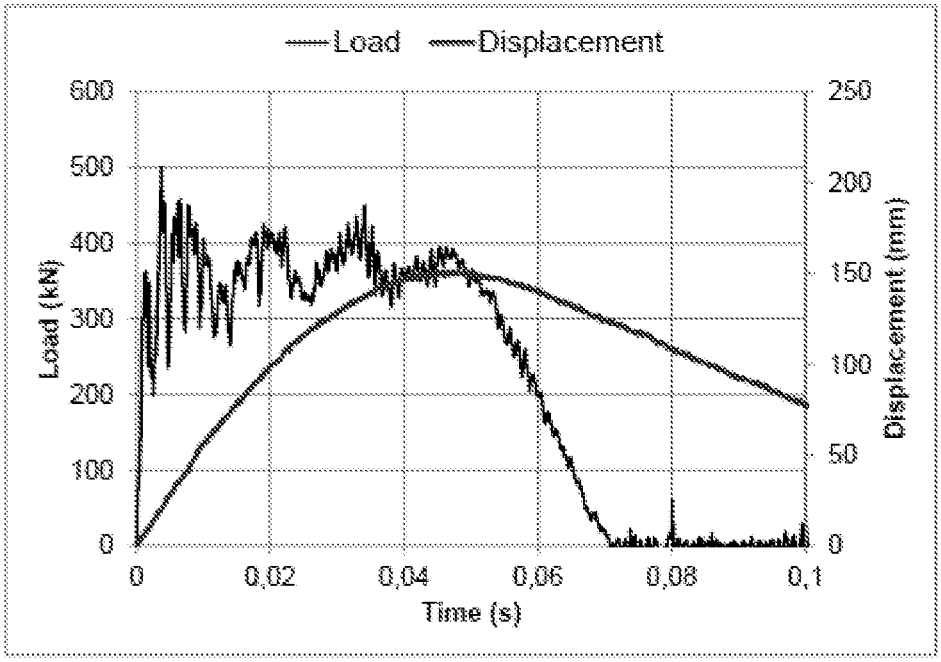
FIG. 49 is a graph depicting the results of test 25, a $3^{rd}$ drop test conducted on the rock bolt after test 24.
Figure 50:
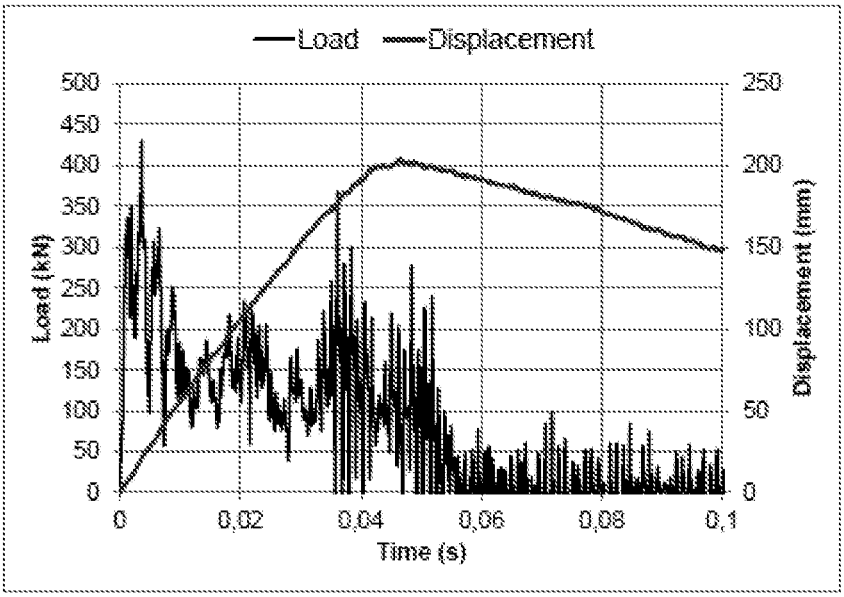
FIG. 50 is a graph depicting the results of test 26, a $4^{th}$ drop test conducted on the rock bolt after test 25.
Figure 51:
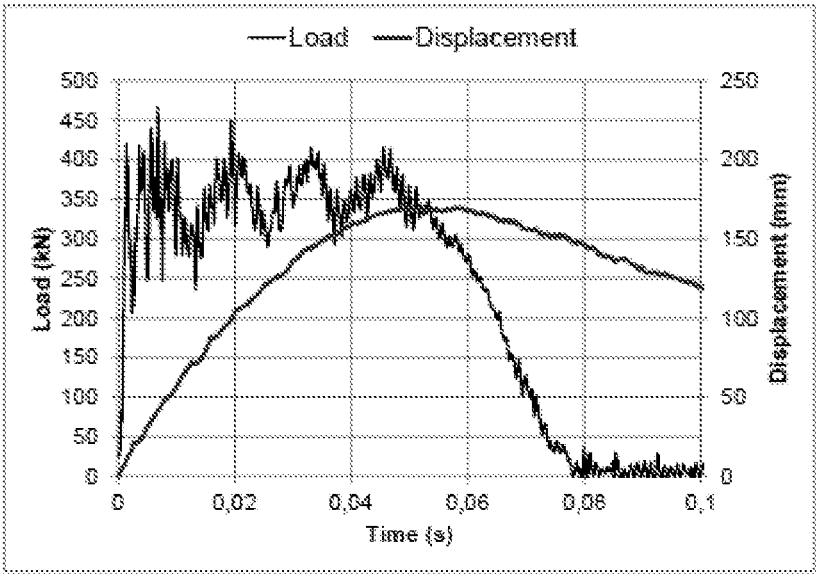
FIG. 51 is a graph depicting the results of test 27, a $2^{nd}$ drop test conducted on the rock bolt after test 9.
Figure 52:
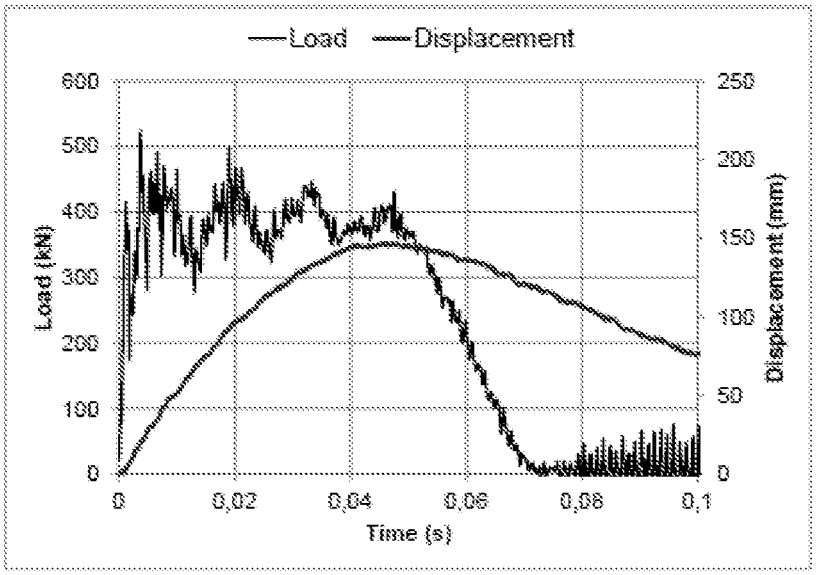
FIG. 52 is a graph depicting the results of test 28, a $3^{rd}$ drop test conducted on the rock bolt after test 27.
Figure 53:
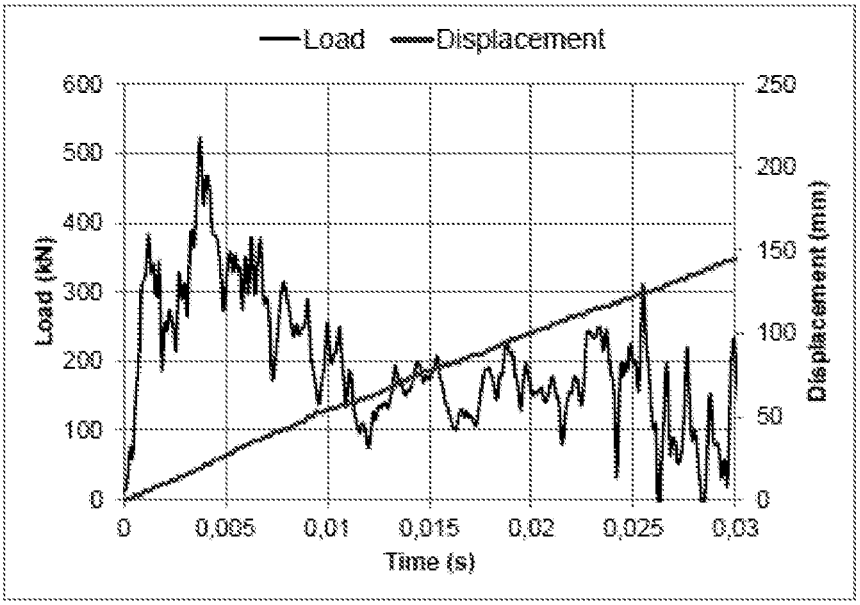
FIG. 53 is a graph depicting the results of test 29, a $4^{th}$ drop test conducted on the rock bolt after test 28.
Figure 54:
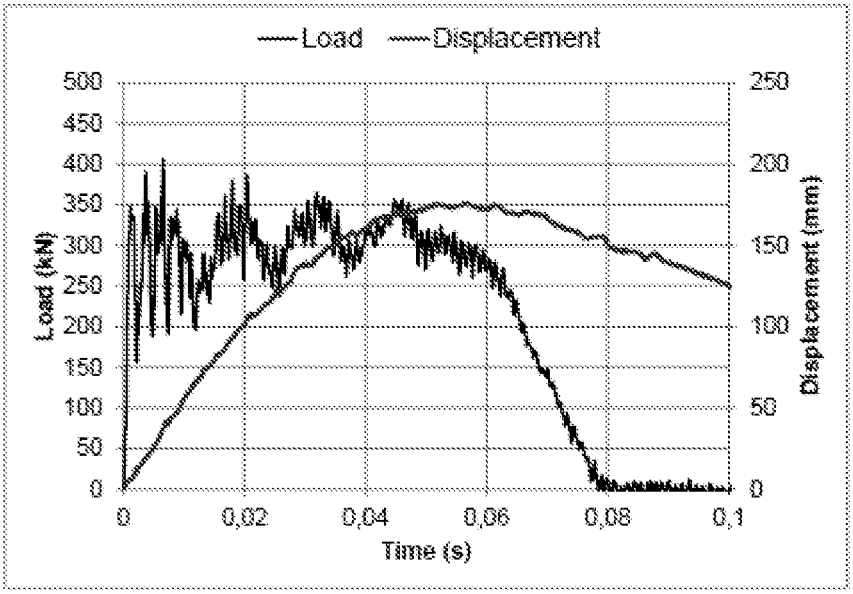
FIG. 54 is a graph depicting the results of test 30, a $2^{nd}$ drop test conducted on the rock bolt after test 10.
Figure 55:
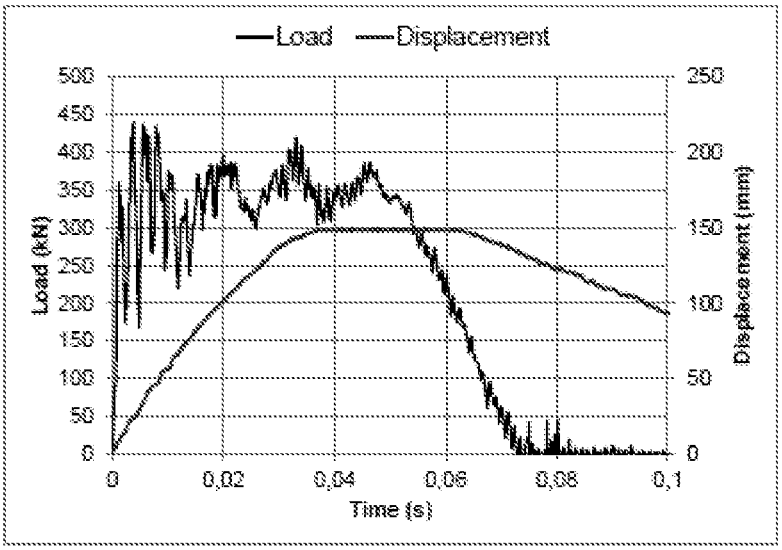
FIG. 55 is a graph depicting the results of test 31, a $3^{rd}$ drop test conducted on the rock bolt after test 30.
Figure 56:
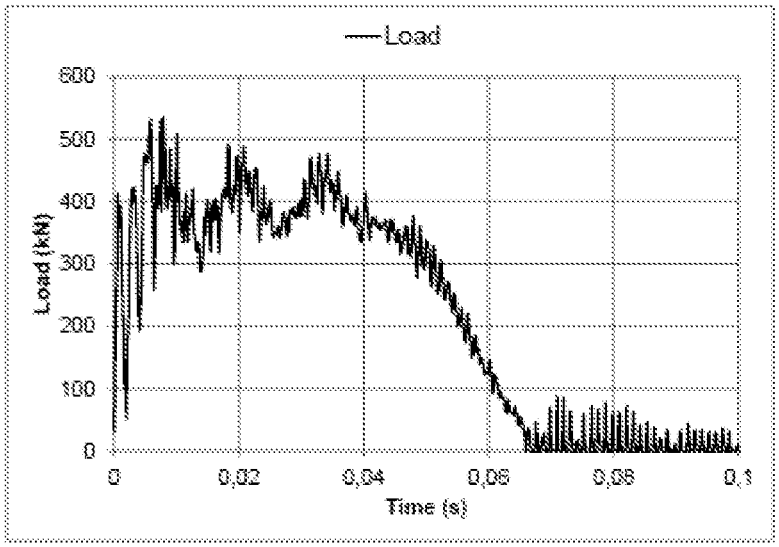
FIG. 56 is a graph depicting the results of test 32, a $4^{th}$ drop test conducted on the rock bolt after test 31.
Figure 57:
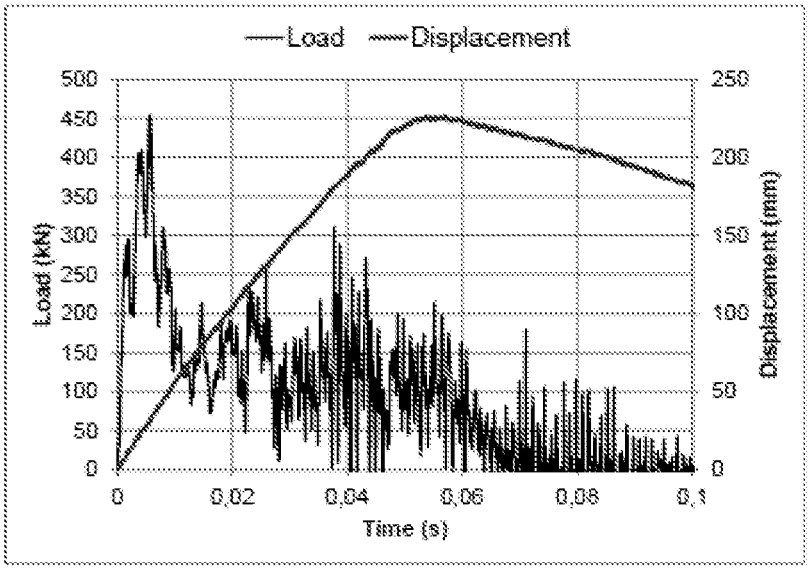
FIG. 57 is a graph depicting the results of test 33, a $5^{th}$ drop test conducted on the rock bolt after test 32.

The results for the dynamic drop tests 6 to 10, which concern the rock bolts in split tubes (load case 1), are represented in the graphs of FIGS. 28 to 32, and the table of FIG. 33.

In tests 6 to 10, the $F_1$ and $F_{max}$ range was between 367.3 kN and 392.8 kN. . The diameter was reduced from 25 mm to a range of between 23.4 and 23.8 mm. The total displacement after the test ($L_{max}$) ranged between 201 and 212 mm, therefore displacement of approximately up to 10% was observed across tests 6 to 10, which is similar to the results obtained in tests 1 to 5. The rock bolts of tests 6 to 10 included 1 nut. The rock bolt was not destroyed and the nut/s were free running after the testing.

After tests 1 to 10, the rock bolts remained entirely functional. In the next series of tests, which are described below, the dynamic impact loads or drops were repeated on some of the rock bolts tested above. These repeated tests were done in order to emulate the performance of the rock bolt which is exposed to aftershocks or the performance of the rock bolt of the invention in a seismic aftershock environment.

In a second series of dynamic testing (tests 11 to 33), the bolts used in tests 1 to 4, 8 to 10 (sample ID 1 to 4, and 8 to 10) were subjected to further impacts/drops.

Referring to FIGS. 34 to 36 and 47, in the multiple drop tests 11 to 13, which included a $2^{nd}$, $3^{rd}$ and $4^{th}$ drops of sample ID 1, an increase in total displacement after testing was observed. In test 11, the $F_1$ was 445.8 kN and $F_{max}$was 514.4 kN, while the total displacement observed was 342 mm (202 mm after $1^{st}$ drop, plus a further 140 mm), which is equivalent to approximately 15% displacement. The rock bolt was not destroyed and the nut was free running after the testing. In test 12, after the $3^{rd}$ drop of sample ID 1, the $F_1$, was 411.9 kN and $F_{max}$ was 516.5 kN, while the total displacement observed was 705 mm, which is equivalent to approximately 31% displacement. In test 13, after the $4^{th}$ drop, the $F_1$ was 365.4 kN and $F_{max}$ was 365.4 kN, while the total displacement observed was greater than 865 mm, which is equivalent to approximately 38% displacement. After tests 12 and 13, there was extension of the bolt rod from the upper section of the pipe, and at this point the bolts lost functionality because of the dislocation of the first end or anchor point of the rock bolt from the resin in the pipe because of the anchor ploughing which occurred, which absorbs energy as the anchor point moves. The bar diameter after the tests was 22.8 mm.

Referring to FIGS. 37 to 40 and 47, observing the results of tests 14 to 17, which involved $2^{nd}$ to $5^{th}$ drops on sample ID 2, the displacement increased to 342 mm after the $2^{nd}$ drop from 203 mm after $1^{st}$ drop, thereafter it increased to 541 mm after the $3^{rd}$ drop, and 619 mm after the $4^{th}$, and 723 after the $5^{th}$ drop. After the $2^{nd}$ drop, the bolt was not destroyed and the nuts were free running. After the $3^{rd}$ and $4^{th}$ drops, the bolt was not destroyed and the nuts were free running. There was extension of the bolt rod from the upper section of the pipe. After the $5^{th}$ drop, the diameter was 21.7 mm.

Looking at the test results of test 18 to 20 illustrated in FIGS. 41 to 43 and 47, which included dropping sample ID 3 a $2^{nd}$ to $4^{th}$ time. The displacement increased from 211 mm after the $1^{st}$ drop to 356 after the $2^{nd}$ drop. This increased to 475 after the $3^{rd}$ drop and after the $4^{th}$ drop there was no measurement, after dislocation of the bolt from the resin. There was thread cutting of the nut. The bar diameter after the tests was 22 mm.

Referring FIGS. 44 to 47, tests 21 to 23 included $2^{nd}$, $3^{rd}$ and $4^{th}$ drop tests carried out on sample ID 4. There was displacement of 350 mm (a further 143 mm in addition to the 207 mm after the $1^{st}$ drop). This increased to 467 mm after the $3^{rd}$ drop. The bolt rod was extending from the pipe after the $4^{th}$ drop, and no displacement was measured as the bolt was dislocated from the resin. The bar diameter was 22.2 mm after these tests.

Referring FIGS. 48 to 50 and 58, tests 24 to 26 included $2^{nd}$, $3^{rd}$ and $4^{th}$ drop tests carried out on sample ID 8. There was displacement of 346 mm after the $2^{nd}$ drop. This increased to 461 mm after the $3^{rd}$ drop, and 650 mm after the $4^{th}$ drop. After the $2^{nd}$ and $3^{rd}$ drops, the bolt was not destroyed and the nuts were free running. After the $4^{th}$ drop, the bolt rod was extending from the pipe, while the bar diameter was 22.2 mm after these tests.

Referring FIGS. 51 to 53 and 58, tests 27 to 29 included $2^{nd}$, $3^{rd}$ and $4^{th}$ drop tests carried out on sample ID 9. There was displacement of 345 mm after the $2^{nd}$ drop. This increased to 460 mm after the $3^{rd}$ drop, and 680 mm after the $4^{th}$ drop. After the $2^{nd}$ and $3^{rd}$ drops, the bolt was not destroyed and the nuts were free running. After the $4^{th}$ drop, the bolt rod was extending from the pipe, while the bar diameter was 22.2 mm after these tests.

Referring FIGS. 54 to 58, tests 30 to 33 included $2^{nd}$, $3^{rd}$, $4^{th}$ and $5^{th}$ drop tests carried out on sample ID 10. There was displacement of 345 mm after the $2^{nd}$ drop. This increased to 471 mm after the $3^{rd}$ drop. After the $2^{nd}$ and $3^{rd}$ drops, the bolt was not destroyed and the nuts were free running. After the $4^{th}$ drop, the displacement was 574 mm and the bolt was not destroyed and the nuts were free running, but the bolt rod was extending from the pipe. After the $5^{th}$ drop the displacement was 782 mm and the rod was extending from the pipe. The bar diameter was 21.6 mm after these tests.

Based on the dynamic testing results discussed above and illustrated in FIGS. 22 to 58, it was observed that the rock bolts elongate successfully without being destroyed or failing. As illustrated by the repeated drop tests on individual samples, the displacement increased as more drops were applied to the rock bolts until the rock bolts lost functionality because of the dislocation from the resin. Therefore the rock bolt of the invention provides an improved-energy absorbing bolt or yielding bolt which exhibits stiff behaviour at the onset of loading, as well as high strength and improved deformation characteristics. This bolt is useful in combatting instability problems such as high stress-induced instability problems, including rock-bursts and rock squeezing.

After observing the dynamic test results, the dynamic load capacity of the rock bolt reached 556 kN.

The invention claimed is:

1. A sleeveless energy absorbing rock bolt, comprising:

a first end of the rock bolt being configured to facilitate the mixing of an anchoring composition and/or anchoring the rock bolt in the rock, the rock bolt comprises manganese alloyed steel, the manganese content of the steel used to manufacture the rock bolt being in the range of approximately 10% to approximately 24%, and the rock bolt exhibits, post the yield point thereof, under static load conditions, an increase in load capacity and elongation with a uniform reduction in diameter without necking or breaking along an entire displacement zone thereof until the break or fail point of the rock bolt is reached, wherein the displacement zone is a smooth bar region of the rock bolt.

2. The rock bolt as claimed in claim 1, wherein a second end of the rock bolt is configured to receive a securing device configured to secure the second end of the rock bolt relative to the rock face.

3. The rock bolt as claimed in claim 2, wherein the rock bolt further includes one or more work-hardened zones defining the displacement zone therebetween, which, under the influence of a sudden dynamic load or static load, instantaneously debonds from the anchoring composition along the length of the displacement zone.

4. The rock bolt as claimed in claim 3, wherein the smooth bar region of the displacement zone has not been work hardened.

5. The rock bolt as claimed in claim 4, wherein the smooth bar region deforms evenly and instantaneously along the length thereof, the deformation being instantaneously and evenly extended upon application of a series of shocks, the quantum of the extension becoming progressively less for each shock received.

6. The rock bolt as claimed in claim 3, wherein the work hardened zones comprise the formation of one or more paddles at the first end to facilitate mixing of the anchoring composition and providing a larger surface area for bonding with the composition.

7. The rock bolt as claimed in claim 6, wherein at the second end, the work hardened zone comprises thread formed on the bar for attachment of the securing device.

8. The rock bolt as claimed in claim 7, wherein the securing device is preferably in the form of a nut, wherein the second end of the rock bolt is threaded to receive the nut for tightening a bearing plate relative to the rock face.

9. The rock bolt as claimed in claim 2, wherein in event of either static or dynamic movement of the rock occurring in the direction of the second end of the rock bolt, which is the downward movement of the rock, the tensile load on the rock bolt increases.

10. The rock bolt as claimed in claim 9, wherein the increase in tensile load on the rock bolt results in the elongation of the smooth bar region, which in turn results in a reduction in the diameter of the rock bolt.

11. The rock bolt as claimed in claim 10, wherein the resulting elongation and reduction in diameter naturally breaks the bond between the rock bolt and the anchoring composition at the smooth bar region.

12. The rock bolt as claimed in claim 11, wherein the reduction in diameter of the rock bolt results in a work hardening of the rock bolt over the length of the smooth bar region which in turn increases the tensile capacity of the rock bolt in that region, thereby increasing the tensile capacity of the rock bolt as the reduction in diameter takes place.

13. The rock bolt as claimed in claim 12, wherein the shear strength of the rock bolt increases as a result of the increase in tensile capacity.

14. The rock bolt as claimed in claim 1, wherein under static load conditions, the increase in load capacity is substantially linear.

15. The rock bolt as claimed in claim 14, wherein under static load conditions, the ultimate tensile strength and break point of the bolt is substantially the same.

16. The rock bolt as claimed in claim 15, wherein post the yield point thereof, under dynamic load conditions, the load capacity and uniform reduction in diameter along the displacement zone of the rock bolt increases until a point or threshold is reached at which the first end of the rock bolt is dislocated from the anchoring composition or dislocated from an anchor point at which the first end is anchored in the rock, and as the first end is dislocated, it starts anchor ploughing or dragging against its surroundings which in turn absorbs additional energy.

17. The rock bolt as claimed in claim 1, wherein the manganese content of the steel used to manufacture the rock bolt is in the range of 10% to 18%.

18. The rock bolt as claimed in claim 1, wherein the length and diameter of the rock bolt are variable in order to achieve higher tensile capacity and elongation of the rock bolt, for use in different situations.

19. The rock bolt as claimed in claim 1, wherein the manganese alloyed steel is a transformation induced plasticity steel, in which metastable austenite transforms to martensite during deformation of the steel.

20. The rock bolt as claimed in claim 1, wherein the dynamic load capacity of the rock bolt reaches 556 kN.

21. The rock bolt as claimed in claim 1, wherein when a static load is applied on the rock bolt and stopped multiple times, the load holds and there is no fall-off of the load on the rock bolt.

* * * * *